US010927651B2

(12) United States Patent
Stromquist et al.

(10) Patent No.: US 10,927,651 B2
(45) Date of Patent: Feb. 23, 2021

(54) APPARATUSES, SYSTEMS AND METHODS FOR PRODUCING HYDROCARBON MATERIAL FROM A SUBTERRANEAN FORMATION USING A DISPLACEMENT PROCESS

(71) Applicant: NCS MULTISTAGE INC., Caglary (CA)

(72) Inventors: Marty Stromquist, Calgary (CA); John Edward Ravensbergen, Calgary (CA); Lyle Laun, Calgary (CA); Tim Johnson, Calgary (CA)

(73) Assignee: NCS MULTISTAGE INC., Calgary (CA)

( * ) Notice: Subject to any disclaimer, the term of this patent is extended or adjusted under 35 U.S.C. 154(b) by 176 days.

(21) Appl. No.: 15/911,871

(22) Filed: Mar. 5, 2018

(65) Prior Publication Data

US 2018/0252079 A1 Sep. 6, 2018

Related U.S. Application Data

(60) Provisional application No. 62/467,455, filed on Mar. 6, 2017, provisional application No. 62/515,708, filed on Jun. 6, 2017.

(51) Int. Cl.

| | |
|---|---|
| ***E21B 43/12*** | (2006.01) |
| ***E21B 47/10*** | (2012.01) |
| ***E21B 43/16*** | (2006.01) |

(52) U.S. Cl.

CPC ..... *E21B 43/12* (2013.01); *E21B 43/162* (2013.01); *E21B 47/10* (2013.01)

(58) Field of Classification Search

CPC ..... E21B 43/12; E21B 47/10; E21B 43/20; E21B 43/2402; E21B 43/2408; E21B 43/25; E21B 43/255

See application file for complete search history.

(56) References Cited

U.S. PATENT DOCUMENTS

| | | | |
|---|---|---|---|
| 4,295,795 | A | 10/1981 | Gass et al. |
| 5,937,945 | A | 8/1999 | Bussear et al. |

(Continued)

FOREIGN PATENT DOCUMENTS

| | | | |
|---|---|---|---|
| CA | 2948273 | | 5/2017 |
| WO | 2001/65056 | A1 | 9/2001 |
| WO | 2016/181154 | A1 | 11/2016 |

OTHER PUBLICATIONS

Azer Abdullayev, Rachit Kedia, Askar Urakov and Cenk Temizel, Optimization of Recovery Using Intelligent Completions in Intelligent Fields, Society of Petroleum Engineers, SPE Annual Caspian Technical Conference and Exhibition, Nov. 1-3, Baku, Azerbaijan, 2017.

*Primary Examiner* — Caroline N Butcher

(74) *Attorney, Agent, or Firm* — Andrus Intellectual Property Law, LLP

(57) ABSTRACT

Apparatuses, systems and methods for producing hydrocarbon material from a subterranean formation using a displacement process are disclosed. In one aspect, there is provided a method of controlling hydrocarbon production of hydrocarbon material disposed within a subterranean formation by a displacement process via a plurality of flow communication stations of an injection well. Characteristics of a supplied production-initiating fluid are determined uphole of the flow communication stations for a plurality of states of the injection well, wherein in each of the states of the injection well a different subset of the flow communication stations are disposed in an opened condition and a different subset of the flow communication stations are disposed in a closed condition. Characteristics may be determined at the surface, for example, at the wellhead. A state of the injection well that optimizes one or more operating parameters is determined. A condition of the flow (Continued)

communication stations is in accordance with the determined state of the injection well.

20 Claims, 10 Drawing Sheets

(56) References Cited

U.S. PATENT DOCUMENTS

| | | | | |
|---|---|---|---|---|
| 6,715,550 | B2 | 4/2004 | Vinegar et al. | |
| 10,323,481 | B2 | 6/2019 | Pratt et al. | |
| 2002/0109080 | A1* | 8/2002 | Tubel | E21B 23/03 250/227.14 |
| 2009/0014168 | A1* | 1/2009 | Tips | E21B 34/14 166/73 |
| 2015/0369023 | A1 | 12/2015 | MacPhail et al. | |
| 2017/0130557 | A1 | 5/2017 | Pratt et al. | |
| 2019/0257173 | A1 | 8/2019 | Pratt et al. | |

* cited by examiner

APPARATUSES, SYSTEMS AND METHODS FOR PRODUCING HYDROCARBON MATERIAL FROM A SUBTERRANEAN FORMATION USING A DISPLACEMENT PROCESS

RELATED APPLICATION DATA

The present application claims priority to U.S. provisional application No. 62/467,455, filed Mar. 6, 2017 and to U.S. provisional application No. 62/515,708, filed Jun. 6, 2017, the entire contents of both of these documents being incorporated by reference herein.

TECHNICAL FIELD

The present disclosure relates to apparatuses, systems and methods for producing hydrocarbon material from a subterranean formation using a drive process.

BACKGROUND

Drive or displacement processes produce hydrocarbon material from a subterranean formation by injecting a pressurized fluid from an injection well into subterranean formation such that hydrocarbon material within a subterranean formation is driven to a production well. In some instances, there is channeling of the injected fluid through the subterranean formation. The channeling results in the injected fluid bypassing the hydrocarbon material contained within the subterranean formation.

DETAILED DESCRIPTION

Figure 1:
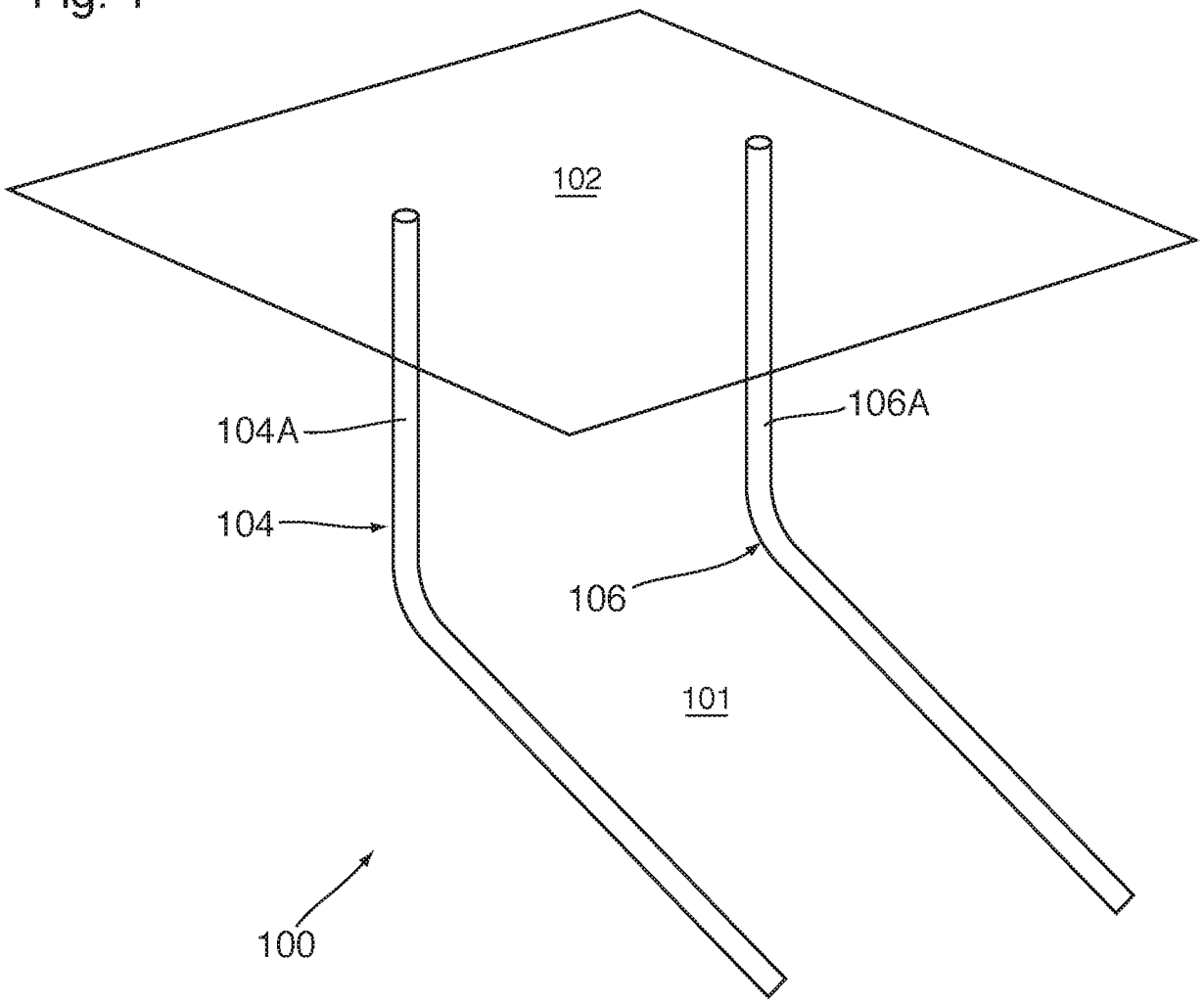
FIG. 1 is a schematic illustration of an embodiment of a system of the present disclosure.

Apparatuses, systems and methods for producing hydrocarbon material from a subterranean formation using a displacement process are disclosed. In one aspect, there is provided a method of controlling hydrocarbon production of hydrocarbon material disposed within a subterranean formation by a displacement process via a plurality of flow communication stations (e.g., valves) of an injection well. Characteristics of a supplied production-initiating fluid are determined uphole of the flow communication stations for a plurality of states of the injection well, wherein in each of the states of the injection well a different subset of the flow communication stations are disposed in an opened condition and a different subset of the flow communication stations are disposed in a closed condition. Characteristics may be determined at the surface, for example, at the wellhead. A state of the injection well that optimizes one or more operating parameters is determined. A condition of the flow communication stations is in accordance with the determined state of the injection well.

In accordance with a first aspect of the present disclosure, there is provided a method of controlling hydrocarbon production of hydrocarbon material disposed within a subterranean formation by a displacement process via a plurality of flow communication stations of an injection well, the injection well having a plurality of states, each state being defined by a subset of the flow communication stations disposed in an opened condition and a subset of the flow communication stations disposed in a closed condition, the method comprising: for at least some of the states of the injection well, (i) setting a condition of the flow communication stations in accordance with a respective state of the injection well, (ii) supplying a production-initiating fluid into the injection well while the injection well is in the respective state, wherein the supplied production-initiating fluid is injected into the subterranean formation via the flow communication stations disposed in the opened condition while the injection well is in the respective state and displaces the hydrocarbon material from the subterranean formation to a production well, and (iii) sensing a characteristic of the supplied production-initiating fluid that is disposed uphole of the flow communication stations while supplying the production-initiating fluid into the injection well and the injection well is in the respective state; determining a state of the injection well that optimizes one or more operating parameters of the injection well based on the sensed characteristic of the supplied production-initiating fluid in each of the respective states of the injection well; and setting a condition of the flow communication stations in accordance with the determined state of the injection well.

In some embodiments, the steps (i) to (iii) are performed for each working state of the injection well, the working states of the injection well being defined by the states of the injection well in which at least one of the flow communication stations is disposed in the open condition.

In some embodiments, the flow communication stations are sequentially set in a condition in accordance with each of the working states of the injection well, wherein in each working state of the injection well a particular subset of the flow communication stations are disposed in the opened condition and a particular subset of the flow communication stations are disposed in the closed condition, wherein the particular flow communication stations that are disposed in the opened condition and closed condition are unique to each working state of the injection well.

In some embodiments, the one or more operating parameters comprise evenly distributing the flow among the flow communication stations.

In some embodiments, the one or more operating parameters comprise a total flow of production-initiating fluid to the flow communication stations.

In some embodiments, the displacement process is fluid injection.

In some embodiments, the characteristic of the supplied production-initiating fluid that is sensed is a rate of flow. In some embodiments, the rate of flow is sensed by a flow meter.

In some embodiments, the production-initiating fluid, whose characteristic is sensed, is a production-initiating fluid that is disposed above a surface of the injection well.

In some embodiments, the production-initiating fluid, whose characteristic is sensed, is a production-initiating fluid that is disposed at a wellhead of the injection well.

In accordance with a second aspect of the present disclosure, there is provided a method of controlling hydrocarbon production of hydrocarbon material disposed within a subterranean formation by a displacement process via a plurality of flow communication stations of a production well, the production well having a plurality of states, each state being defined by a subset of the flow communication stations disposed in an opened condition and a subset of the flow communication stations disposed in a closed condition, the method comprising: for at least some of the states of the production well, (i) setting a condition of the flow communication stations in accordance with a respective state of the production well, (ii) injecting a production-initiating fluid into the subterranean formation while the production well is in the first state, and (iii) sensing a characteristic of the produced hydrocarbon material that is disposed uphole of the flow communication stations while the production well is in the first state; determining a state of the production well that optimizes one or more operating parameters of the production well based on the sensed characteristic of the produced hydrocarbon material in the respective states of the production well; and setting a condition of the flow communication stations in accordance with the determined state of the production well.

In some embodiments, the steps (i) to (iii) are performed for each working state of the production well, the working states of the production well being defined by the states of the production well in which at least one of the flow communication stations is disposed in the open condition.

In some embodiments, the flow communication stations are sequentially set in a condition in accordance with each of the working states of the production well, wherein in each working state of the production well a particular subset of the flow communication stations are disposed in the opened condition and a particular subset of the flow communication stations are disposed in the closed condition, wherein the particular flow communication stations that are disposed in the opened condition and closed condition are unique to each working state of the production well.

In some embodiments, the one or more operating parameters comprise evenly distributing the flow among the flow communication stations.

In some embodiments, the one or more operating parameters comprise a total flow of produced hydrocarbon material.

In some embodiments, the displacement process is fluid injection.

In some embodiments, the characteristic of the produced hydrocarbon material that is sensed is a rate of flow. In some embodiments, the rate of flow is sensed by a flow meter.

In some embodiments, the characteristic of the produced hydrocarbon material that is sensed is a water cut of the produced hydrocarbon material. In some embodiments, the water cut of the produced hydrocarbon material is sensed by a water cut meter.

In some embodiments, the produced hydrocarbon material, whose characteristic is sensed, is a produced hydrocarbon material that is disposed above a surface of the production well.

In some embodiments, the produced hydrocarbon material, whose characteristic is sensed, is a produced hydrocarbon material that is disposed at a wellhead of the production well.

In accordance with a further aspect of the present disclosure, there is provided a control system for an injection apparatus of an injection well or production well for hydrocarbon production, the injection apparatus comprising a plurality of flow communication stations, each flow communication stations being in communication with a respective formation containing hydrocarbon material, the control system being configured to perform at least parts of the methods described herein. The methods described herein. In some embodiments, the control system comprises a memory having tangibly stored thereon executable instructions for execution by the at least one processor that, when executed by the at least one processor, cause the control system to perform at least parts of the methods described herein.

In accordance with yet a further aspect of the present disclosure, there is provided a non-transitory machine readable medium having tangibly stored thereon executable instructions for execution by at least one processor of a control system, wherein the executable instructions, when executed by the at least one processor, cause the control system to perform at least parts of the methods described herein.

Referring to FIG. 1, there is provided a hydrocarbon producing system 100 including an injection well 104 and a production well 106. The injection well 104 includes a wellbore 104A for injecting production-stimulating material from the surface 102 and into the subterranean formation 101. The production well 106 includes a wellbore 106A for receiving hydrocarbon material that is displaced and driven by the injected production-stimulating material and conducting the received hydrocarbon material to the surface.

Each one of the wellbores 104A, 106A, independently, can be straight, curved, or branched and can have various wellbore sections. A wellbore section is an axial length of a wellbore. A wellbore section can be characterized as "vertical" or "horizontal" even though the actual axial orientation can vary from true vertical or true horizontal, and even though the axial path can tend to "corkscrew" or otherwise vary. The term "horizontal", when used to describe a wellbore section, refers to a horizontal or highly deviated wellbore section as understood in the art, such as, for example, a wellbore section having a longitudinal axis that is between 70 and 110 degrees from vertical.

Figure 2:
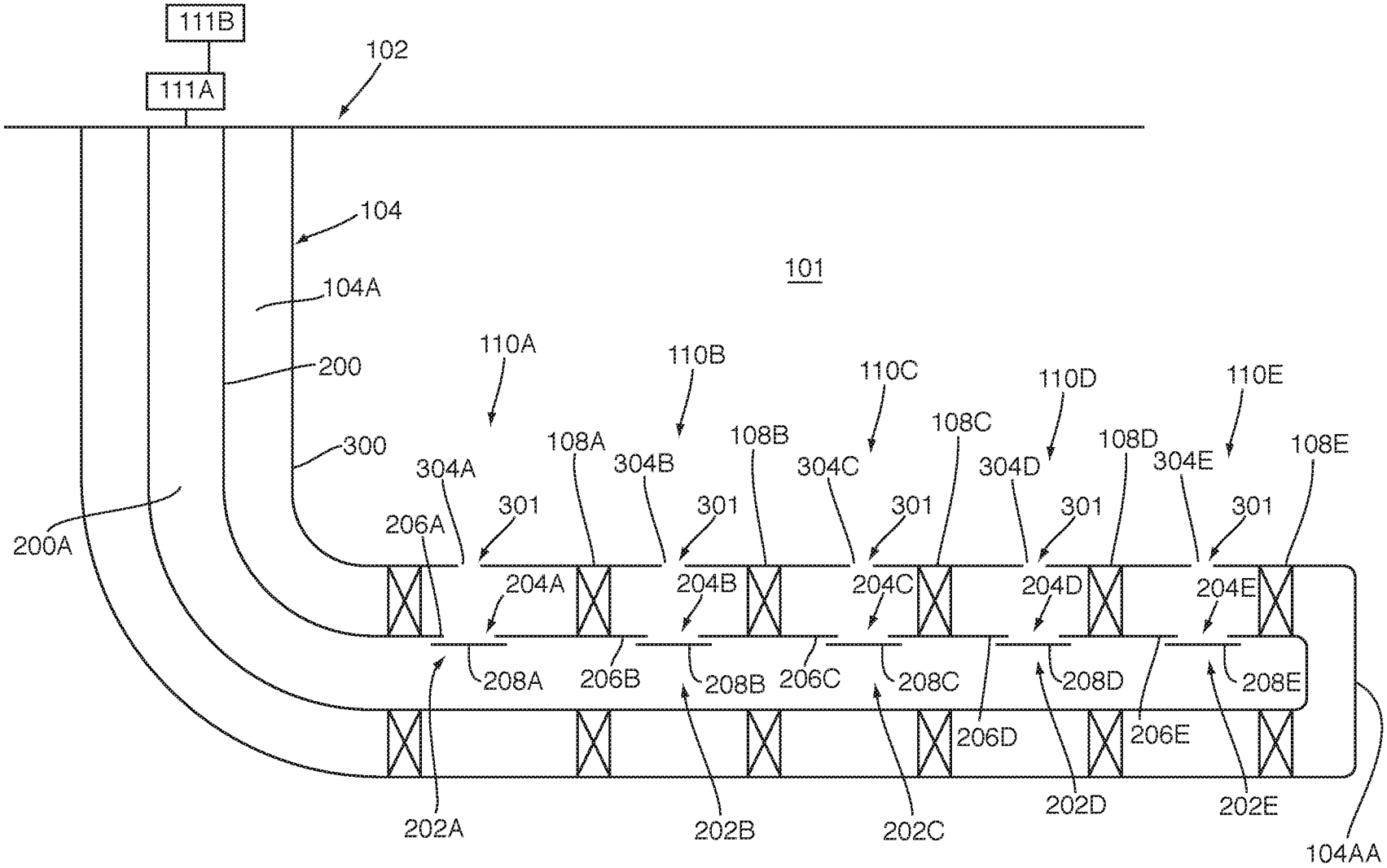
FIG. 2 is a schematic illustration of an injection well of the system shown in FIG. 1, with all of the fluid communication stations disposed in the closed condition.

Referring to FIG. 2, the injection of the production-stimulating material from the surface 102 to the subterranean formation 101, via the injection well 104, is effected via one or more flow communication stations (five (5) flow communications 110A-E are illustrated). Successive flow communication stations may be spaced from each other along the wellbore such that each one of the flow communication stations 110A-E, independently, is positioned adjacent a zone or interval of the subterranean formation 101 for effecting flow communication between the wellbore 104A and the zone (or interval).

The production-stimulating material is injected through the wellbore 104A of the injection well 104 via an injection conduit 200, such as an injection string including an injection string passage 200A. The injection string 200 is disposed within the injection well 104. The production-stimulating material is injected from the injection conduit 200 into the wellbore 104A.

For effecting the flow communication between the injection string 200 and the wellbore 104A, at each one of the flow communication stations 110A-E, independently, the injection string 200 includes a respective flow control apparatus 202A-E. Each one of the flow control apparatuses 202A-E, independently, includes a respective flow communicator 204A-E through which the injection of the production-stimulating material, into the wellbore, is effectible. In some embodiments, for example, each one of the flow communicators 204A-E, independently, includes one or more ports. Each one of the flow control apparatuses 204A-E, independently, includes a respective housing 206A-E configured for integration within the injection string 200. The integration may be effected, for example, by way of threading or welding.

Each one of the flow control apparatuses 204A-E includes a respective flow control member 208A-E. Each one of the flow control members 208A-E, independently, is configured for controlling the conducting of material by the flow control apparatus 202A-E via a respective one of the injection string flow communicators 204A-E. Each one of the flow control members 208A-E, independently, is displaceable, relative to the respective one of the injection string flow communicators 204A-E, for effecting opening of the respective one of the injection string flow communicators 204A-E. In some embodiments, for example, each one of the flow control members 208A-E is also displaceable, relative to the respective one of the injection string flow communicators 204A-E, for effecting closing of the respective one of the injection string flow communicators 204A-E. In this respect, each one of the flow control members 208A-E is displaceable from a closed position to an open position. The open position corresponds to an open condition of the respective one of the injection string flow communicators 204A-E. The closed position corresponds to a closed condition of the respective one of the injection string flow communicators 204A-E. For each one of the injection string flow communicators 204A-E, independently, an open condition of the injection string flow communicator corresponds to an open condition of a respective one of the flow communication stations 110A-E. For each one of the injection string flow communicators 204A-E, independently, a closed condition of the injection string flow communicator corresponds to a closed condition of a respective one of the flow communication stations 110A-E.

For each one of the injection string flow communicators 204A-E, independently, in the closed position, the injection string flow communicator is covered by the respective one of the flow control members 208A-E, and the displacement of the respective one of the flow control members 208A-E to the open position effects at least a partial uncovering of the flow communicator such that the flow communicator become disposed in the open condition. In some embodiments, for example, for each one of the flow control members 208A-E, independently, in the closed position, the flow control member is disposed, relative to the respective one of the injection string flow communicators 204A-E, such that a sealed interface is disposed between the injection string passage 200A and the wellbore 104A, and the disposition of the sealed interface is such that the conduction of production-initiating material between the injection string passage 200A and the wellbore 104A, via the respective one of the injection string flow communicators 204A-E is prevented, or substantially prevented, and displacement of the flow control member to the open position effects flow communication, via the respective one of the injection string flow communicators 204A-E, between the injection string passage 200A and the subterranean formation 101, such that the conducting of production-initiating material from the injection string passage 200A and the wellbore 104A, via the respective one of the injection string flow communicators 204A-E, is enabled. In some embodiments, for example, for each one of the flow control members 208A-E, independently, the sealed interface is established by sealing engagement of the flow control member relative to a respective one of the housings 206A-E. In some embodiments, for example, the each one of the flow control members 208A-E, independently, includes a sleeve. In some embodiments, for example, the sleeve is slideably disposed relative the respective one of the housings 206A-E.

In some embodiments, for example, one or more of the flow control members 208A-E, independently, are displaceable by a shifting tool. In some embodiments, for example, one or more of the flow control members 208A, independently, are displaceable in response to receiving of an actuation signal.

In some embodiments, for example, the injection well 104 includes a cased-hole completion. In such embodiments, the wellbore 104A is lined with casing 300.

A cased-hole completion involves running casing 300 down into the wellbore 104A through the production zone. The casing 300 at least contributes to the stabilization of the subterranean formation 101 after the wellbore 104A has been completed, by at least contributing to the prevention of the collapse of the subterranean formation 101 that is defining the wellbore 101. In some embodiments, for example, the casing 300 includes one or more successively deployed concentric casing strings, each one of which is positioned within the wellbore 104A, having one end extending from the wellhead 12. In this respect, the casing strings are typically run back up to the surface. In some embodiments, for example, each casing string includes a plurality of jointed segments of pipe. The jointed segments of pipe typically have threaded connections.

The annular region between the deployed casing 300 and the subterranean formation 101 may be filled with zonal isolation material for effecting zonal isolation. The zonal isolation material is disposed between the casing 300 and the subterranean formation 101 for the purpose of effecting isolation, or substantial isolation, of one or more zones of the subterranean formation from fluids disposed in another zone of the subterranean formation. Such fluids include formation fluid being produced from another zone of the subterranean formation 101 (in some embodiments, for example, such formation fluid being flowed through a production string disposed within and extending through the casing 300 to the surface), or injected stimulation material. In this respect, in some embodiments, for example, the zonal isolation material is provided for effecting sealing, or substantial sealing, of flow communication between one or more zones of the subterranean formation and one or more others zones of the subterranean formation via space between the casing 300 and the subterranean formation 101. By effecting the sealing, or substantial sealing, of such flow communication, isolation, or substantial isolation, of one or more zones of the subterranean formation 101, from another subterranean zone (such as a producing formation) via the is achieved. Such isolation or substantial isolation is desirable, for example, for mitigating contamination of a water table within the subterranean formation by the formation fluids (e.g. oil, gas, salt water, or combinations thereof) being produced, or the above-described injected fluids.

In some embodiments, for example, the zonal isolation material is disposed as a sheath within an annular region between the casing 300 and the subterranean formation 101. In some embodiments, for example, the zonal isolation material is bonded to both of the casing 300 and the subterranean formation 101. In some embodiments, for example, the zonal isolation material also provides one or more of the following functions: (a) strengthens and reinforces the structural integrity of the wellbore, (b) prevents, or substantially prevents, produced formation fluids of one zone from being diluted by water from other zones. (c) mitigates corrosion of the casing 300, and (d) at least contributes to the support of the casing 300. The zonal isolation material is introduced to an annular region between the casing 300 and the subterranean formation 101 after the subject casing 300 has been run into the wellbore 104A. In some embodiments, for example, the zonal isolation material includes cement.

Figure 3:
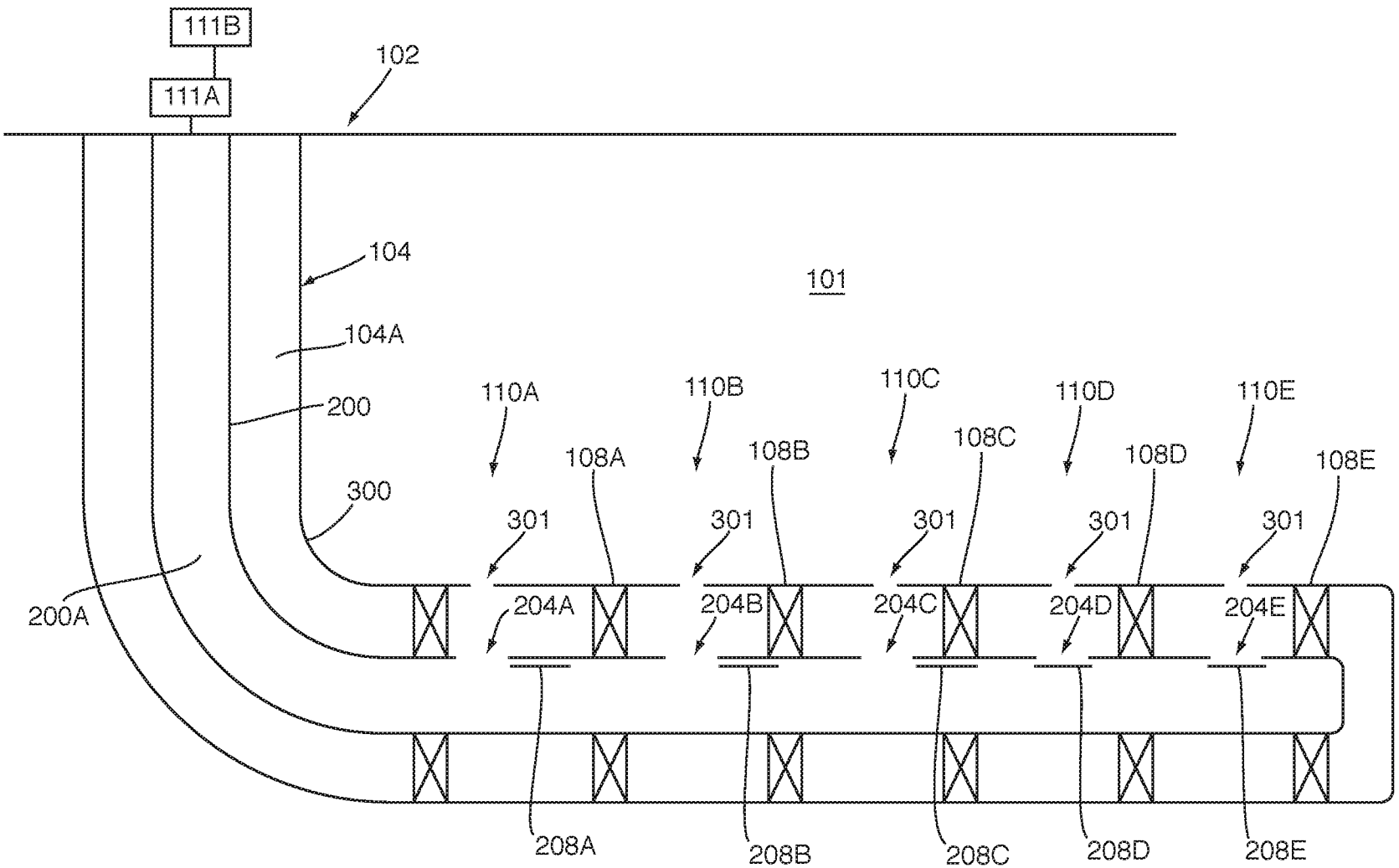
FIG. 3 is a schematic illustration of the injection well shown in FIG. 2, with three of the flow communication stations disposed in the open condition, and two of the flow communication stations disposed in the closed condition.
Figure 4:
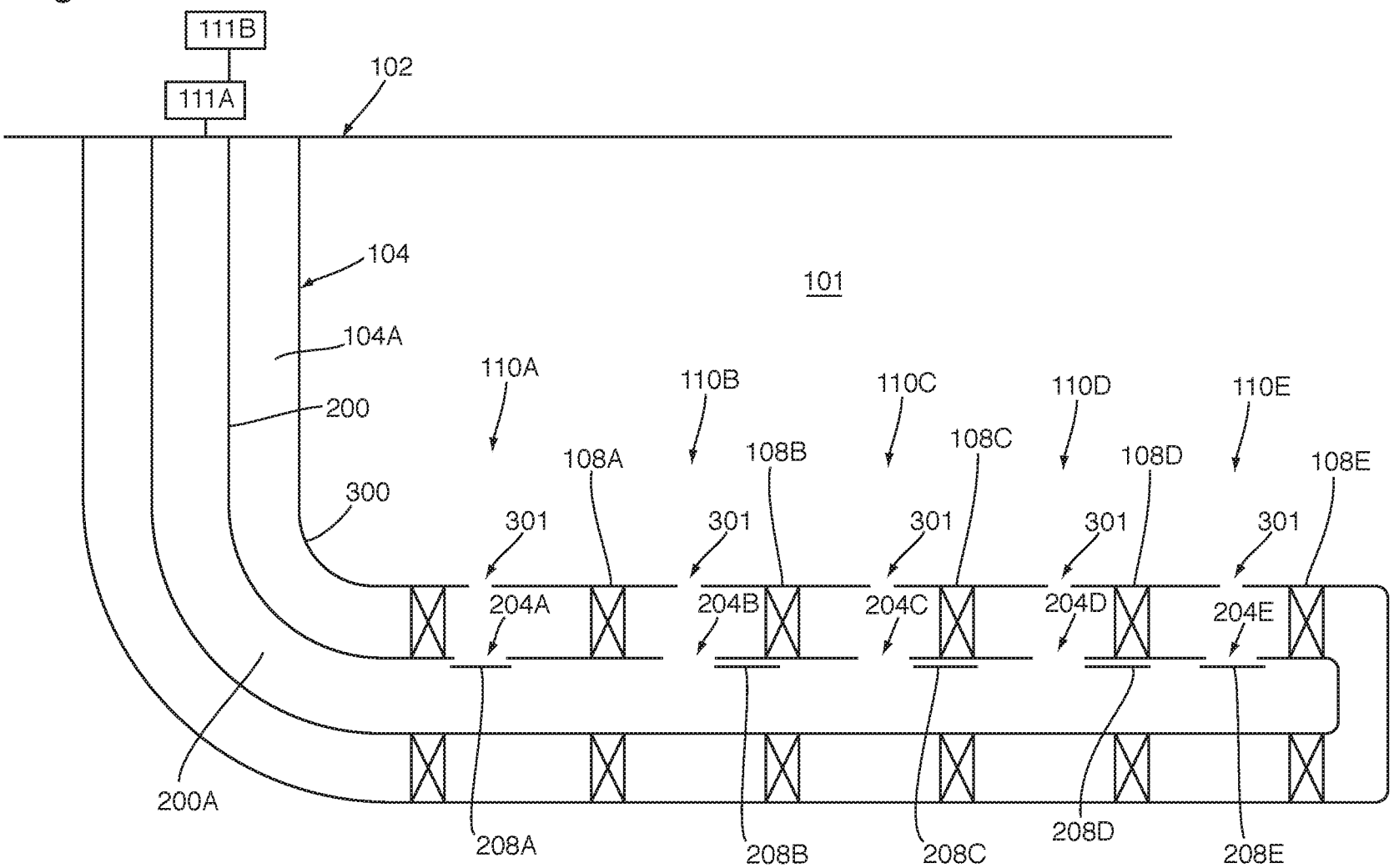
FIG. 4 is a schematic illustration of the injection well shown in FIG. 2, with one of the previously open flow communication stations having become closed, and with one of the previously closed flow communication stations having become opened.

In those embodiments where the injection well 104 includes a cased completion, in some of these embodiments, for example, the casing includes the plurality of casing flow communicators 304A-E, and for each one of the flow communication stations 110A-E, independently, the flow communication between the wellbore 104A and the subterranean formation 101, for effecting the injection of the production-initiating fluid, is effected through the respective one of the casing flow communicators 304A-E. In some embodiments, for example, each one of the casing flow communicators 304, independently, is defined by one or more openings 301. In some embodiments, for example, the openings are defined by one or more ports that are disposed within a sub that has been integrated within the casing string 300, and are pre-existing, in that the ports exists before the sub, along with the casing string 300, has been installed downhole within the wellbore 104A. Referring to FIGS. 2 to 4, in some embodiments, for example, the openings are defined by perforations 301 within the casing string 300, and the perforations are created after the casing string 300 has been installed within the wellbore 104A, such as by a perforating gun. In some embodiments, for example, for each one of the flow communication stations 110A-E, independently, the respective one of the casing flow communicator 304A-E is disposed in alignment, or substantial alignment, with the respective one of the injection string flow communicators 204A-E.

In this respect, in those embodiments where the injection well 104 includes a cased completion, in some of these embodiments, for example, for each one of the flow communication stations 110A-E, flow communication, via the flow communication station, is effectible between the surface 102 and the subterranean formation 101 via the injection string 104, the respective one of the injection string flow communicators 204A-E, the annular space 104B within the wellbore 104A between the injection string 200 and the casing string 300, and the respective one of the casing string flow communicators 304A-E.

In some embodiments, for example, the injection well 104 includes an open-hole completion. An open-hole completion is effected by drilling down to the top of the producing formation, and then casing the wellbore 104A. The wellbore is then drilled through the producing formation, and the bottom of the wellbore is left open (i.e. uncased), to effect flow communication between the reservoir and the wellbore. Open-hole completion techniques include bare foot completions, pre-drilled and pre-slotted liners, and open-hole sand control techniques such as stand-alone screens, open hole gravel packs and open hole expandable screens.

In this respect, in those embodiments where the injection well 104 includes an open-hole completion, in some of these embodiments, for example, for each one of the flow communication stations 110A-E, flow communication, via the flow communication station, is effectible between the surface 102 and the subterranean formation 101 via the injection string 200, the respective one of the injection string flow communicator 204A-E, and the annular space between the injection string 200 and the subterranean formation 101.

In some embodiments, for example, while injecting production-initiating fluid is being injected into the subterranean formation 101 via a one of the flow communication stations 110A-E (the "stimulation-effecting flow communication station"), for each one of the adjacent flow communication stations, independently, a sealed interface is disposed within the wellbore 104A-E for preventing, or substantially preventing, flow communication, via the wellbore, between the stimulation-effecting flow communication station and the adjacent flow communication station. In this respect, with respect to the embodiment illustrated in FIG. 1, a plurality of sealed interfaces 108A-D are provided. In some embodiments, for example, the sealed interface is established by a packer.

In some embodiments, for example, with respect to the flow communication station that is disposed furthest downhole (i.e. flow communication station 110E), a further sealed interface 108E is disposed within the wellbore 104A for preventing, or substantially preventing, flow communication between the flow communication station 110E and a downhole-disposed portion 104AA of the wellbore 104A.

In those embodiments where the completion is a cased completion, in some of these embodiments, for example, the sealed interface extends across the annular space between the injection string 200 and the casing string 300. In those embodiments where the completion is an open hole completion, in some of these embodiments, for example, the sealed interface extends across the annular space between the injection string 200 and the subterranean formation 101.

In one aspect, there is provided a process for stimulating hydrocarbon production from the subterranean formation 101. The process includes injecting production-stimulating material from the surface 102 to the subterranean formation 101 via the injection well 104, with effect that hydrocarbon material is displaced to the production well 106, and producing the received hydrocarbon material via the production well 106. In some embodiments, for example, the production-stimulating material includes a liquid, such as a liquid including water. In some embodiments, for example, the liquid includes water and chemical additives. In some embodiments, for example, the process is waterflooding.

Referring to FIG. 3, in some embodiments, for example, the process includes, opening a first subset of the flow communication stations 110E, such that:

(i) a first opened subset (in the embodiment illustrated in FIG. 3, this is the flow communication stations 110C) of the flow communication stations 110E is defined and are disposed in the open condition; and (ii) a first unopened subset 110D, 110E of the flow communication stations 110A-E is defined.

While the first opened subset 110A-C is disposed in an opened condition and the first unopened subset of the flow communication stations is disposed in a closed condition, during a first time interval:

(i) supplying production-initiating fluid into the injection well 104, such that the supplied production initiating material is injected into the subterranean formation 101 via the first opened subset 110A-C and displaces the hydrocarbon material from the subterranean formation to the production well 106; and (ii) sensing a first characteristic of the supplied production-initiating fluid.

In some embodiments, for example, the sensing is that of a first characteristic of the supplied production-initiating fluid that is disposed uphole relative to the first opened subset 110A-C.

In some embodiments, for example, the sensing is that of a first characteristic of the supplied production-initiating fluid that is disposed upstream relative to the first opened subset 110A-C.

In some embodiments, for example, the sensing is effected uphole relative to the first opened subset 110A-C.

In some embodiments, for example, the sensing is effected upstream relative to the first opened subset 110A-C.

In some embodiments, for example, the production-initiating fluid, whose first characteristic is sensed, is production-initiating fluid that is disposed above the surface, at the wellhead, or both, and the production-initiating fluid, whose second characteristic is sensed, is production-initiating fluid that is disposed above the surface, at the wellhead, or both.

Referring to FIG. 4, after completion of the first time interval (during which the production-initiating material has been injected into the subterranean formation 101 via the flow communication stations 110A-C), the process further includes:

(i) closing a total number of "N" of the flow communication stations of the first opened subset (in the illustrated embodiment, the flow communication station 110A becomes closed); and (ii) opening a total number of "N" of the flow communication stations of the first unopened subset (in the illustrated embodiment, the flow communication station 110D becomes opened);

with effect that:

(ii.a) "N" flow communication stations of the first opened subset become closed (in the illustrated embodiment, a single flow communication stations, flow communication station 110A, becomes closed);

(ii.b) "N" flow communication stations of the first unopened subset become opened (in the illustrated embodiment, a single flow communication stations, flow communication station 110D, becomes opened); and (ii.c) a second opened subset of flow communication stations becomes defined (in the illustrated embodiment, this is flow communication stations 110B-D)

"N" is an integer that is greater than, or equal to, one (1). In the illustrated embodiment, N=1.

While the second opened subset of flow communication stations is disposed in the open condition, the process further includes, during a second time interval that is after the first time interval:

(i) supplying production-initiating material into the injection well 104 such that the supplied production initiating material is injected into the subterranean formation 101 via the second opened subset 110B-D and displaces the hydrocarbon material from the subterranean formation to the production well 106; and (ii) sensing a second characteristic of the supplied production-initiating fluid.

In some embodiments, for example, the sensing is that of a second characteristic of the supplied production-initiating fluid that is disposed uphole relative to the second opened subset 110B-D.

In some embodiments, for example, the sensing is that of a second characteristic of the supplied production-initiating fluid that is disposed upstream relative to the second opened subset 110B-D.

In some embodiments, for example, the sensing is effected uphole relative to the second opened subset 110B-D.

In some embodiments, for example, the sensing is effected upstream relative to second opened subset 110B-D.

After both of the first characteristic and the second characteristic have been sensed, the first characteristic is compared with the second characteristic. In some embodiments, for example, based on the comparison, it is determined whether the first characteristic is different than the second characteristic.

In some embodiments, for example, in response to the determination that the first characteristic is different than the second characteristic, co-operatively, for each one of: (i) the "N" flow communication stations of the first opened subset that became closed after completion of the first interval (i.e. flow communication station 110A) and (ii) the "N" flow communication stations of the first unopened subset that became opened after completion of the first interval (i.e. flow communication stations 110D), establishing a position of the flow control member 208A, 208D relative to the flow communicator 204A, 204D, based upon the determination.

In some embodiments, for example, the position of each one of the flow control members 208A, 208D, independently, is established by displacing the flow control member relative to the flow communicator.

In some embodiments, for example, the position of each one of the flow control members 208A, 208D, independently, is established by modulating (increasing or decreasing) occlusion of the flow communicator with the flow control member.

In some embodiments, for example, the position of each one of the flow control members 208A, 208D, independently, is established by sealing, or substantially sealing, the flow communicator with the flow control member.

In some embodiments, for example, the establishing of the position of each one of the flow control members 208A, 208D, independently, is with effect that an injection of production-initiating fluid, through the flow communicator is prevented or substantially prevented.

In some embodiments, for example, the first characteristic is a first rate of flow, and the second characteristic is a second rate of flow, and the rate of flow of the production-initiating fluid being injected through a one of the first opened subset 110A-C and the second opened subset 110B-D is greater than the rate of flow of production-initiating fluid being injected through the other one of the first opened subset 110A-C and the second opened subset 110B-D, such as, for example, by at least a minimum predetermined amount. In this respect, in some of these embodiments, for example, the sensing of the first and second characteristics is effected by a flow transmitter 111A, such as a flowmeter, coupled to a controller 111B. The flow transmitter 111A measures the first and second characteristics, such as a flow rate of the production-initiating fluid and transmits a corresponding signal is transmitted to the controller 111B. The controller 111B is coupled to the flow control members 208A-E and transmits signals thereto causing the modulation of the opening and closing of the flow communicators 204A-E. The controller 111B may be a control system, an example of which is described below in connection with FIG. 8.

In some embodiments, for example, for each one of: (i) the "N" flow communication stations of the first opened subset that became closed after completion of the first interval (i.e. flow communication station 110A) and (ii) the "N" flow communication stations of the first unopened subset that became opened after completion of the first interval (i.e. the flow communication stations 110D), the establishing of the position of the flow control member relative to the flow communicator is with effect that resistance to an injection of production-initiating fluid, through a one of: (i) the "N" flow communication stations of the first opened subset that became closed after completion of the first interval, and (ii) the "N" flow communication stations of the first unopened subset that became opened after completion of the first interval, is greater (i.e. the flow is more choked) than the resistance to an injection of production-initiating fluid, through the other one of: (i) the "N" flow communication stations of the first opened subset that became closed after completion of the first interval (i.e. flow communication station 110A), and (ii) the "N" flow communication stations of the first unopened subset that became opened after completion of the first interval (i.e. flow communication station 110D).

In some embodiments, for example, for each one of: (i) the "N" flow communication stations of the first opened subset that became closed after completion of the first interval (i.e. flow communication station 110A), and (ii) the "N" flow communication stations of the first unopened subset that became opened after completion of the first interval (i.e. flow communication station 110D), the establishing of the position of the flow control member relative to the flow communicator is with effect that, for one or more of the flow communication stations of the one of: (i) the "N" flow communication stations of the first opened subset that became closed after completion of the first interval (i.e. flow communication station 110A), and (ii) the "N" flow communication stations of the first unopened subset that became opened after completion of the first interval (i.e. flow communication station 110D), independently, an injection of production-initiating fluid, through the flow communicator is prevented or substantially prevented.

In some embodiments, for example, for each one of: (i) the "N" flow communication stations of the first opened subset that became closed after completion of the first interval (i.e. flow communication station 110A), and (ii) the "N" flow communication stations of the first unopened subset that became opened after completion of the first interval (i.e. flow communication station 110D), the establishing of the position of the flow control member relative to the flow communicator is with effect that, for one or more of the flow communication stations of the one of: (i) the "N" flow communication stations of the first opened subset that became closed after completion of the first interval (i.e. flow communication station 110A), and (ii) the "N" flow communication stations of the first unopened subset that became opened after completion of the first interval (i.e. flow communication station 110D), independently, the flow communicator is sealed or substantially sealed.

In the above-described embodiments, for example, the one of:

(i) the "N" flow communication stations of the first opened subset that became closed after completion of the first interval (i.e. flow communication station 110A), and (ii) the "N" flow communication stations of the first unopened subset that became opened after completion of the first interval (i.e. the flow communication station 110D);

are one or more flow communication stations of the one of the first opened subset 110A-C and the second opened subset 110B-D through which the production-initiating fluid has been injected at the rate of flow that is greater than the rate of flow of the production-initiating fluid that has been injected through the other one of the first opened subset 110A-C and the second opened subset 110B-D, such as, for example, and where applicable, at least by the minimum predetermined amount.

In another aspect, there is provided a process for producing hydrocarbon material disposed within the subterranean formation via a plurality of flow communication stations of the production well 106.

Figure 5:
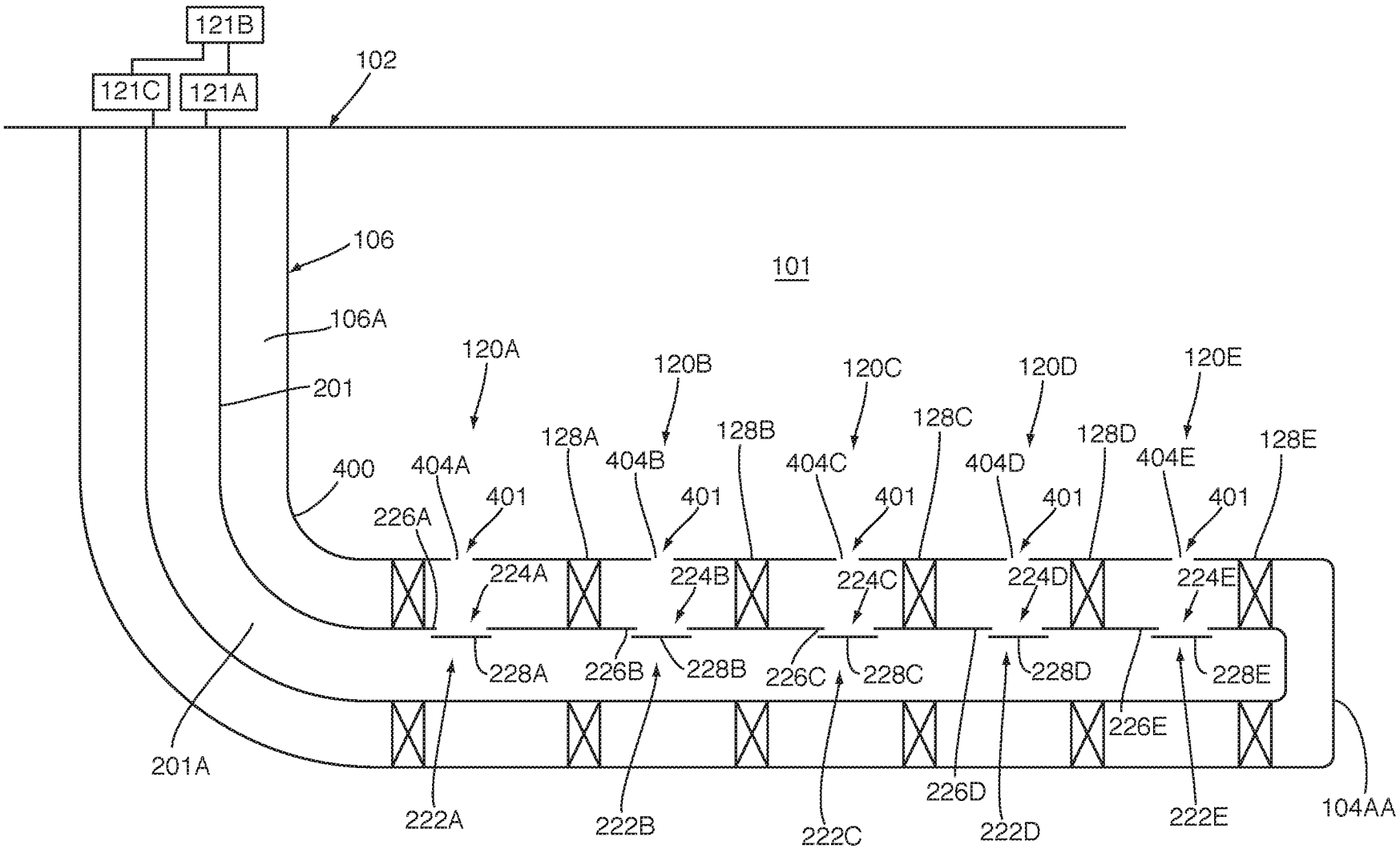
FIG. 5 is a schematic illustration of a production well of the system shown in FIG. 1, with all of the fluid communication stations disposed in the closed condition.
Figure 6:
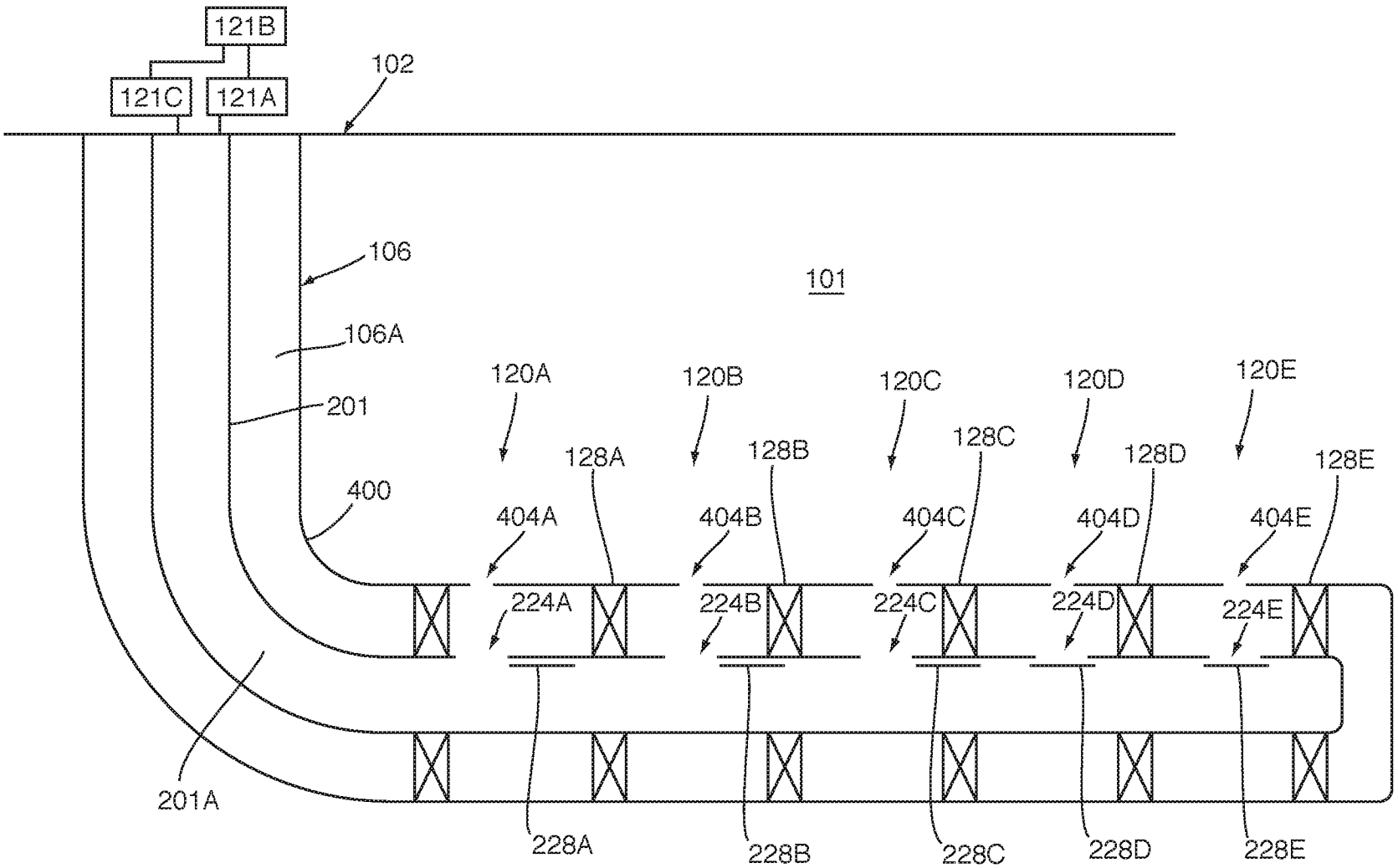
FIG. 6 is a schematic illustration of the production well shown in FIG. 5, with three of the flow communication stations disposed in the open condition, and two of the flow communication stations disposed in the closed condition.
Figure 7:
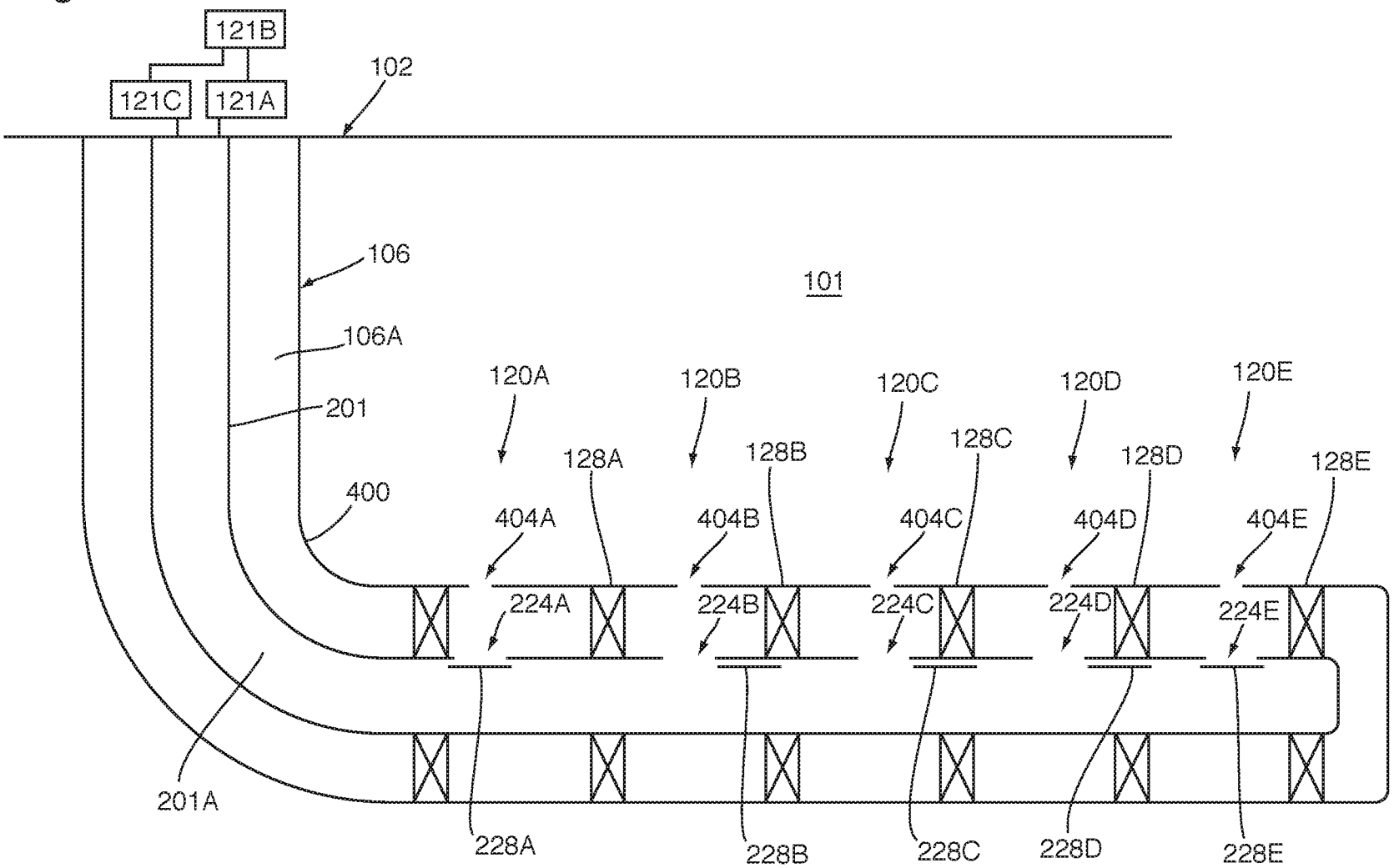
FIG. 7 is a schematic illustration of the production well shown in FIG. 5, with one of the previously open flow communication stations having become closed, and with one of the previously closed flow communication stations having become opened.

Referring to FIGS. 5 to 7, the production of hydrocarbon material from the subterranean formation 101 to the surface 102, via the production well 104, is effected via one or more flow communication stations (five (5) flow communications 120A-E are illustrated). Successive flow communication stations may be spaced from each other along the wellbore such that each one of the flow communication stations 120A-E, independently, is positioned adjacent a zone or interval of the subterranean formation 101 for effecting flow communication between the wellbore 106A and the zone (or interval).

The produced hydrocarbon material is conducted through the wellbore 106A of the production well 106 via a production conduit 201, such as a production string 201 including a production string passage 201A. The production string 201 is disposed within the production well 106. The produced hydrocarbon material is received within the wellbore 106 and then flows into the production conduit 201 for conduction to the surface 102.

For effecting the flow communication between the production string 201 and the wellbore 106A, at each one of the flow communication stations 120A-E, independently, the production string 201 includes a respective flow control apparatus 222A-E. Each one of the flow control apparatuses 222A-E, independently, includes a respective flow communicator 224A-E through which produced hydrocarbon material is receivable from the wellbore 106A. In some embodiments, for example, each one of the flow communicators 224A-E, independently, includes one or more ports. Each one of the flow control apparatuses 224A-E, independently, includes a respective housing 226A-E configured for integration within the production string 201. The integration may be effected, for example, by way of threading or welding.

Each one of the flow control apparatuses 224A-E includes a respective flow control member 228A-E. Each one of the flow control members 228A-E, independently, is configured for controlling the conducting of material by the flow control apparatus 222A-E via a respective one of the production string flow communicators 224A-E. Each one of the flow control members 228A-E, independently, is displaceable, relative to the respective one of the production string flow communicators 224A-E, for effecting opening of the respective one of the production string flow communicators 224A-E. In some embodiments, for example, each one of the flow control members 228A-E is also displaceable, relative to the respective one of the production string flow communicators 224A-E, for effecting closing of the respective one of the production string flow communicators 224A-E. In this respect, each one of the flow control members 208A-E is displaceable from a closed position to an open position. The open position corresponds to an open condition of the respective one of the production string flow communicators 224A-E. The closed position corresponds to a closed condition of the respective one of the production string flow communicators 224A-E. For each one of the production string flow communicators 224A-E, independently, an open condition of the production string flow communicator corresponds to an open condition of a respective one of the flow communication stations 120A-E. For each one of the production string flow communicators 224A-E, independently, a closed condition of the production string flow communicator corresponds to a closed condition of a respective one of the flow communication stations 120A-E.

For each one of the production string flow communicators 224A-E, independently, in the closed position (see FIG. 5), the production string flow communicator is covered by the respective one of the flow control members 228A-E, and the displacement of the respective one of the flow control members 228A-E to the open position effects at least a partial uncovering of the flow communicator such that the flow communicator become disposed in the open condition. In some embodiments, for example, for each one of the flow control members 228A-E, independently, in the closed position, the flow control member is disposed, relative to the respective one of the production string flow communicators 224A-E, such that a sealed interface is disposed between the production string passage 201A and the wellbore 106A, and the disposition of the sealed interface is such that the conduction of produced hydrocarbon material between the wellbore 106A and the production string passage 201A, via the respective one of the production string flow communicators 224A-E is prevented, or substantially prevented, and displacement of the flow control member to the open position effects flow communication, via the respective one of the production string flow communicators 224A-E, between the production string passage 201A and the subterranean formation 101, such that the conducting of production-initiating material from the wellbore 106A to the production string passage 201A, via the respective one of the production string flow communicators 224A-E, is enabled. In some embodiments, for example, for each one of the flow control members 208A-E, independently, the sealed interface is established by sealing engagement of the flow control member relative to a respective one of the housings 206A-E. In some embodiments, for example, the each one of the flow control members 208A-E, independently, includes a sleeve. In some embodiments, for example, the sleeve is slideably disposed relative the respective one of the housings 206A-E.

In some embodiments, for example, one or more of the flow control members 208A-E, independently, are displaceable by a shifting tool. In some embodiments, for example, one or more of the flow control members 208A, independently, are displaceable in response to receiving of an actuation signal.

In some embodiments, for example, the production well 106 includes a cased-hole completion. In such embodiments, and analogously to that described above with respect to the wellbore 104A, the wellbore 106A is lined with casing 400, and the annular region between the deployed casing 400 and the subterranean formation 101 may be filled with zonal isolation material for effecting zonal isolation.

In those embodiments where the production well 106 includes a cased completion, in some of these embodiments, for example, the casing includes the plurality of casing flow communicators 404A-E, and for each one of the flow communication stations 120A-E, independently, the flow communication between the wellbore 106A and the subterranean formation 101, for effecting the injection of the production-initiating fluid, is effected through the respective one of the casing flow communicators 404A-E. In some embodiments, for example, each one of the casing flow communicators 404, independently, is defined by one or more openings 401. In some embodiments, for example, the openings are defined by one or more ports that are disposed within a sub that has been integrated within the casing string 400, and are pre-existing, in that the ports exists before the sub, along with the casing string 400, has been installed downhole within the wellbore 106A. In some embodiments, for example, the openings are defined by perforations 401 within the casing string 400, and the perforations are created after the casing string 400 has been installed within the wellbore 106A, such as by a perforating gun. In some embodiments, for example, for each one of the flow communication stations 120A-E, independently, the respective one of the casing flow communicator 404A-E is disposed in alignment, or substantial alignment, with the respective one of the production string flow communicators 224A-E.

In this respect, in those embodiments where the production well 106 includes a cased completion, in some of these embodiments, for example, for each one of the flow communication stations 120A-E, flow communication, via the flow communication station, is effectible between the subterranean formation 101 and the surface 102 via the production string 201, the respective one of the production string flow communicators 224A-E, the annular space 106B within the wellbore 106A between the production string 201 and the casing string 400, and the respective one of the casing string flow communicators 404A-E.

In some embodiments, for example, the production well 106 includes an open-hole completion. An open-hole completion is effected by drilling down to the top of the producing formation, and then casing the wellbore 106A. The wellbore is then drilled through the producing formation, and the bottom of the wellbore is left open (i.e. uncased), to effect flow communication between the reservoir and the wellbore. Open-hole completion techniques include bare foot completions, pre-drilled and pre-slotted liners, and open-hole sand control techniques such as standalone screens, open hole gravel packs and open hole expandable screens.

In this respect, in those embodiments where the production well 106 includes an open-hole completion, in some of these embodiments, for example, for each one of the flow communication stations 120A-E, flow communication, via the flow communication station, is effectible between the surface 102 and the subterranean formation 101 via the production string 201, the respective one of the production string flow communicator 224A-E, and the annular space between the production string 201 and the subterranean formation 101.

In some embodiments, for example, while hydrocarbon material is being produced from the subterranean formation 101 via a one of the flow communication stations 120A-E (the "stimulation-effecting flow communication station"), for each one of the adjacent flow communication stations, independently, a sealed interface is disposed within the wellbore 106A-E for preventing, or substantially preventing, flow communication, via the wellbore, between the flow communication station and the adjacent flow communication station. In this respect, with respect to the embodiment illustrated in FIGS. 5 to 7, a plurality of sealed interfaces 128A-D are provided. In some embodiments, for example, the sealed interface is established by a packer.

In those embodiments where the completion is a cased completion, in some of these embodiments, for example, the sealed interface extends across the annular space between the production string 201 and the casing string 400. In those embodiments where the completion is an open hole completion, in some of these embodiments, for example, the sealed interface extends across the annular space between the production string 201 and the subterranean formation 101.

The process for producing hydrocarbon material disposed within the subterranean formation via the plurality of flow communication stations 120A-E of the production well 106, includes, during a first time interval, injecting production-initiating material into the subterranean formation 101.

Referring to FIG. 6, while a first opened subset 120A-C of the flow communication stations 120A-E is disposed in an open condition, and a first unopened subset 120D, 120E of the flow communication stations 120A-E is disposed in a closed condition:

(i) via the first opened subset 120A-C, receiving produced hydrocarbon material, that is displaced from the subterranean formation 101 by the injected production-initiating material, within the production well 106 such that the produced hydrocarbon material is conducted to the surface 102;

and (ii) sensing a first characteristic of the produced hydrocarbon material.

In some embodiments, for example, the sensing is that of a first characteristic of the supplied production-initiating fluid that is disposed uphole relative to the first opened subset 120A-C.

In some embodiments, for example, the sensing is that of a first characteristic of the supplied production-initiating fluid that is disposed downstream relative to the first opened subset 120A-C.

In some embodiments, for example, the sensing is effected uphole relative to the first opened subset 120A-C.

In some embodiments, for example, the sensing is effected downstream relative to the first opened subset 120A-C.

In some embodiments, for example, the produced hydrocarbon material, whose first characteristic is sensed, is produced hydrocarbon material that is disposed above the surface, at the wellhead, or both, and the produced hydrocarbon material, whose second characteristic is sensed, is produced hydrocarbon material that is disposed above the surface, at the wellhead, or both.

Referring to FIG. 7, after completion of the first time interval (during which the produced hydrocarbon material has been produced from the subterranean formation 101 via the flow communication stations 120A-C, the process further includes:

(i) closing a total number of "N" of the flow communication stations of the first opened subset (in the illustrated embodiment, flow communication station 120A becomes closed); and (ii) opening a total number of "N" of the flow communication stations of the first unopened subset (in the illustrated embodiment, flow communication station 120D becomes opened);

with effect that:

(ii.a) "N" flow communication stations of the first opened subset become closed;

(ii.b) "N" flow communication stations of the first unopened subset become opened; and (ii.c) a second opened subset of flow communication stations is defined (in the illustrated embodiment, this would be flow communication stations 120B-D).

"N" is an integer that is greater than, or equal to, one (1). In the illustrated embodiment, N=1.

The process further includes, during a second time interval that is after the first time interval:

injecting production-initiating material into the subterranean formation 101;

while the second opened subset 120B-D is disposed in the open condition:

(i) via the second opened subset 120B-D, receiving produced hydrocarbon material, that is displaced from the subterranean formation 101 by the injected production-initiating material, within the production well 106 such that the produced hydrocarbon material is conducted to the surface 102;

and (ii) sensing a second characteristic of the produced hydrocarbon material.

In some embodiments, for example, the sensing is that of a second characteristic of the supplied production-initiating fluid that is disposed uphole relative to the second opened subset 120B-D.

In some embodiments, for example, the sensing is that of a second characteristic of the supplied production-initiating fluid that is disposed downstream relative to the second opened subset 120B-D.

In some embodiments, for example, the sensing is effected uphole relative to the second opened subset 120B-D.

In some embodiments, for example, the sensing is effected downstream relative to second opened subset 120B-D.

After both of the first characteristic and the second characteristic have been sensed, the first characteristic is compared with the second characteristic. In some embodiments, for example, based on the comparison, it is determined whether the first characteristic is different than the second characteristic.

In some embodiments, for example, in response to the determination that the first characteristic is different than the second characteristic, co-operatively, for each one of: (i) the "N" flow communication stations of the first opened subset that became closed after completion of the first interval (i.e. flow communication station 120A) and (ii) the "N" flow communication stations of the first unopened subset that became opened after completion of the first interval (i.e. flow communication stations 120D), establishing a position of the flow control member 228A, 228D relative to the flow communicator 224A, 224D, based upon the determination.

In some embodiments, for example, the position of each one of the flow control members 228A, 228D, independently, is established by displacing the flow control member relative to the flow communicator.

In some embodiments, for example, the position of each one of the flow control members 228A, 228D, independently, is established by modulating (increasing or decreasing) occlusion of the flow communicator with the flow control member.

In some embodiments, for example, the position of each one of the flow control members 228A, 228D, independently, is established by sealing, or substantially sealing, the flow communicator with the flow control member.

In some embodiments, for example, the establishing of the position of each one of the flow control members 228A, 228D, independently, is with effect that production of hydrocarbon material, through the flow communicator, is prevented or substantially prevented.

In some embodiments, for example, the first characteristic is a first rate of flow, and the second characteristic is a second rate of flow, and the rate of flow of the produced hydrocarbon material being produced through a one of the first opened subset 120A-C and the second opened subset 120B-D is greater than the rate of flow of the produced hydrocarbon material being produced through the other one of the first opened subset 120A-C and the second opened subset 120B-D, such as, for example, by at least a minimum predetermined amount. In this respect, in some of these embodiments, for example, the sensing of the first and second characteristics is effected by a flow transmitter 121A, such as a flowmeter, coupled to a controller 111B. The flow transmitter 111A measures the first and second characteristics, such as a flow rate of the production-initiating fluid and transmits a corresponding signal is transmitted to the controller 121B. The controller 121B is coupled to the flow control members 228A-E and transmits signals thereto causing the modulation of the opening and closing of the flow communicators 224A-E. The controller 121B may be a control system, an example of which is described below in connection with FIG. 8.

In some embodiments, for example, for each one of: (i) the "N" flow communication stations of the first opened subset that became closed after completion of the first interval (i.e. flow communication station 120A) and (ii) the "N" flow communication stations of the first unopened subset that became opened after completion of the first interval (i.e. the flow communication stations 120D), the establishing of the position of the flow control member relative to the flow communicator is with effect that resistance to production of produced hydrocarbon material, through a one of: (i) the "N" flow communication stations of the first opened subset that became closed after completion of the first interval, and (ii) the "N" flow communication stations of the first unopened subset that became opened after completion of the first interval, is greater than the resistance to production of produced hydrocarbon material through the other one of: (i) the "N" flow communication stations of the first opened subset that became closed after completion of the first interval (i.e. flow communication station 120A), and (ii) the "N" flow communication stations of the first unopened subset that became opened after completion of the first interval (i.e. flow communication station 120D).

In some embodiments, for example, for each one of: (i) the "N" flow communication stations of the first opened subset that became closed after completion of the first interval (i.e. flow communication station 120A), and (ii) the "N" flow communication stations of the first unopened subset that became opened after completion of the first interval (i.e. flow communication station 120D), the establishing of the position of the flow control member relative to the flow communicator is with effect that, for one or more of the flow communication stations of the one of: (i) the "N" flow communication stations of the first opened subset that became closed after completion of the first interval (i.e. flow communication station 120A), and (ii) the "N" flow communication stations of the first unopened subset that became opened after completion of the first interval (i.e. flow communication station 120D), independently, production of produced hydrocarbon material, through the flow communicator, is prevented or substantially prevented.

In some embodiments, for example, for each one of: (i) the "N" flow communication stations of the first opened subset that became closed after completion of the first interval (i.e. flow communication station 120A), and (ii) the "N" flow communication stations of the first unopened subset that became opened after completion of the first interval (i.e. flow communication station 120D), the establishing of the position of the flow control member relative to the flow communicator is with effect that, for one or more of the flow communication stations of the one of: (i) the "N" flow communication stations of the first opened subset that became closed after completion of the first interval (i.e. flow communication station 120A), and (ii) the "N" flow communication stations of the first unopened subset that became opened after completion of the first interval (i.e. flow communication station 120D), independently, the flow communicator is sealed or substantially sealed.

In the above-described embodiments, for example, the one of:

(i) the "N" flow communication stations of the first opened subset that became closed after completion of the first interval (i.e. flow communication station 120A), and (ii) the "N" flow communication stations of the first unopened subset that became opened after completion of the first interval (i.e. the flow communication station 120D);

are one or more flow communication stations of the one of the first opened subset 120A-C and the second opened subset 120B-D through which the produced hydrocarbon material has been produced at the rate of flow that is greater than the rate of flow of the produced hydrocarbon material that has been produced through the other one of the first opened subset 120A-C and the second opened subset 120B-D, such as, for example, and where applicable, at least by the minimum predetermined amount.

In some embodiments, for example, the first characteristic is a first water cut, and the second characteristic is a second water cut, and the water cut of the produced hydrocarbon material being produced from the production well 106 via a one of the first opened subset 120A-C and the second opened subset 120B-D is greater than the water cut of the produced hydrocarbon material being produced from the production well 106 via the other one of the first opened subset 120A-C and the second opened subset 120B-D, such as, for example, by at least a minimum predetermined value. In this respect, in some of these embodiments, for example, the sensing of the first and second characteristics is effected by a water cut meter 121C coupled to the controller 121B. The water cut meter 121C measures the first and second characteristics, such as a water cut of the produced hydrocarbon material being produced from the production well 106, and transmits a corresponding signal is transmitted to the controller 121B. The controller 121B is coupled to the flow control members 228A-E and transmits signals thereto causing the modulation of the opening and closing of the flow communicators 224A-E.

In some embodiments, for example, for each one of: (i) the "N" flow communication stations of the first opened subset that became closed after completion of the first interval (i.e. flow communication station 120A), and (ii) the "N" flow communication stations of the first unopened subset that became opened after completion of the first interval (i.e. flow communication station 120D), the establishing of the position of the flow control member relative to the flow communicator is with effect that resistance to production of produced hydrocarbon material, through a one of: (i) the "N" flow communication stations of the first opened subset that became closed after completion of the first interval (i.e. flow communication station 120A), and (ii) the "N" flow communication stations of the first unopened subset that became opened after completion of the first interval (i.e. flow communication station 120D), is greater than the resistance to production of produced hydrocarbon material, through the other one of: (i) the "N" flow communication stations of the first opened subset that became closed after completion of the first interval (i.e. flow communication station 120A), and (ii) the "N" flow communication stations of the first unopened subset that became opened after completion of the first interval (i.e. flow communication station 120D).

In some embodiments, for example, In some embodiments, for example, for each one of: (i) the "N" flow communication stations of the first opened subset that became closed after completion of the first interval (i.e. flow communication station 120A), and (ii) the "N" flow communication stations of the first unopened subset that became opened after completion of the first interval (i.e. flow communication station 120D), the establishing of the position of the flow control member relative to the flow communicator is with effect that, for one or more of the flow communication stations of the one of: (i) the "N" flow communication stations of the first opened subset that became closed after completion of the first interval (i.e. flow communication station 120A), and (ii) the "N" flow communication stations of the first unopened subset that became opened after completion of the first interval (i.e. flow communication station 120D), independently, production of produced hydrocarbon material, through the flow communicator, is prevented or substantially prevented.

In some embodiments, for example, for each one of: (i) the "N" flow communication stations of the first opened subset that became closed after completion of the first interval (i.e. flow communication station 120A), and (ii) the "N" flow communication stations of the first unopened subset that became opened after completion of the first interval (i.e. flow communication station 120D), the establishing of the position of the flow control member relative to the flow communicator is with effect that, for one or more of the flow communication stations of the one of: (i) the "N" flow communication stations of the first opened subset that became closed after completion of the first interval (i.e. flow communication station 120A), and (ii) the "N" flow communication stations of the first unopened subset that became opened after completion of the first interval (i.e. flow communication station 120D), independently, the flow communicator is sealed or substantially sealed.

In the above-described embodiments, for example, the one of:

(i) the "N" flow communication stations of the first opened subset that became closed after completion of the first interval (i.e. flow communication station 120A), and (ii) the "N" flow communication stations of the first unopened subset that became opened after completion of the first interval (i.e. the flow communication station 120D);

are one or more flow communication stations of the one of the first opened subset 120A-C and the second opened subset 120B-D through which the produced hydrocarbon material has been produced and has a water cut that is greater than the water cut of produced hydrocarbon material that has been produced through the other one of the first opened subset 120A-C and the second opened subset 120B-D, such as, for example, and where applicable, at least by the minimum predetermined amount.

In some embodiments, for example, by controlling injection of production-initiating fluid, in accordance with any one of the above-described embodiments, channeling of the production-initiating fluid is better managed.

In some embodiments, for example, by controlling production of produced hydrocarbon material, in accordance with any one of the above-described embodiments, breakthrough of the production-initiating fluid is better managed.

In some embodiments, for example, by (i) controlling injection of production-initiating fluid, in accordance with any one of the above-described embodiments, (ii) controlling production of produced hydrocarbon material, in accordance with any one of the above-described embodiments, or (iii) both of (i) and (ii), production of hydrocarbon material from the subterranean formation is more uniform.

Figure 8:
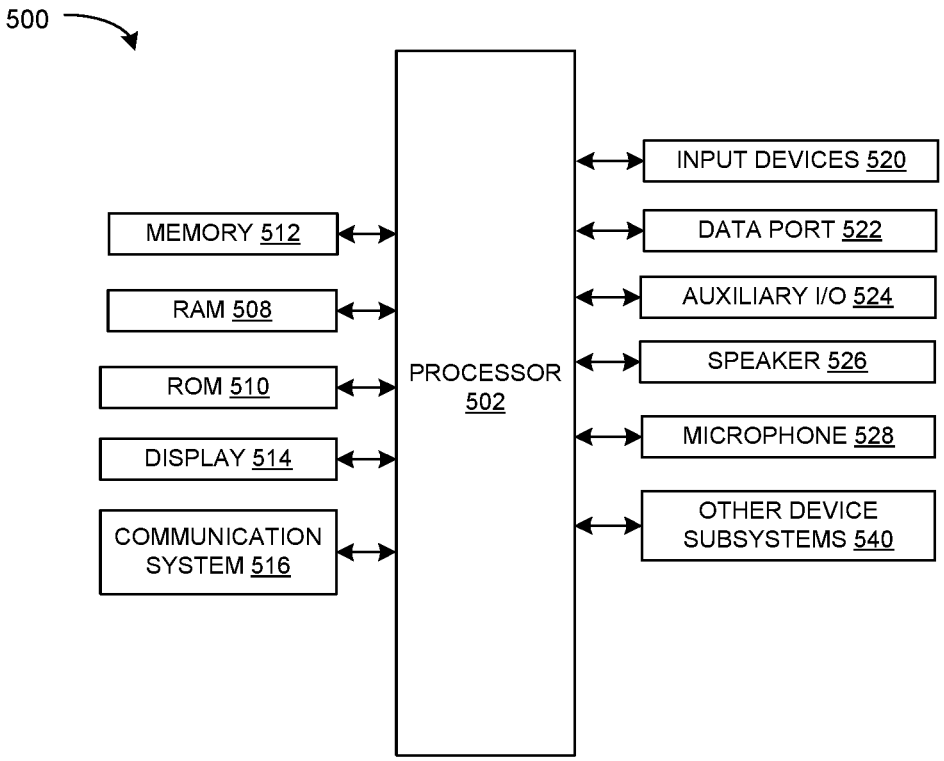
FIG. 8 is a block diagram of a control system in accordance with one example embodiment of the present disclosure.

Reference is next made to FIG. 8 which illustrates in simplified block diagram form a control system 500 for an injection well 104 or production well 106 in accordance with the present disclosure. The control system 500 is located at the surface 102. The control system 500 includes a controller comprising at least one processor 502 (such as a microprocessor) which controls the overall operation of the control system 500. The processor 502 is coupled to a plurality of components via a communication bus (not shown) which provides a communication path between the components and the processor 502. The control system 500 may comprises or be coupled to a supervisory control and data acquisition (SCADA) system.

The control system 500 comprises RAM 508, ROM 510, a persistent memory 512 which may be flash memory or other suitable form of memory, a communication subsystem 516 for wired and/or wireless communication, one or more input device(s) 520, a data port 522 such as a serial data port, auxiliary input/outputs (I/O) 524, and other devices subsystems 540. The input device(s) 520 may include a keyboard or keypad, one or more buttons, one or more switches, a touchpad, a rocker switch, a thumbwheel, or other type of input device.

Operating system software executed by the processor 502 is stored in the persistent memory 512 but may be stored in other types of memory devices, such as ROM 510 or similar storage element. The persistent memory 512 includes installed applications and user data, such as saved files, among other data. The processor 502, in addition to its operating system functions, enables execution of software applications on the control system 500.

Figure 9:
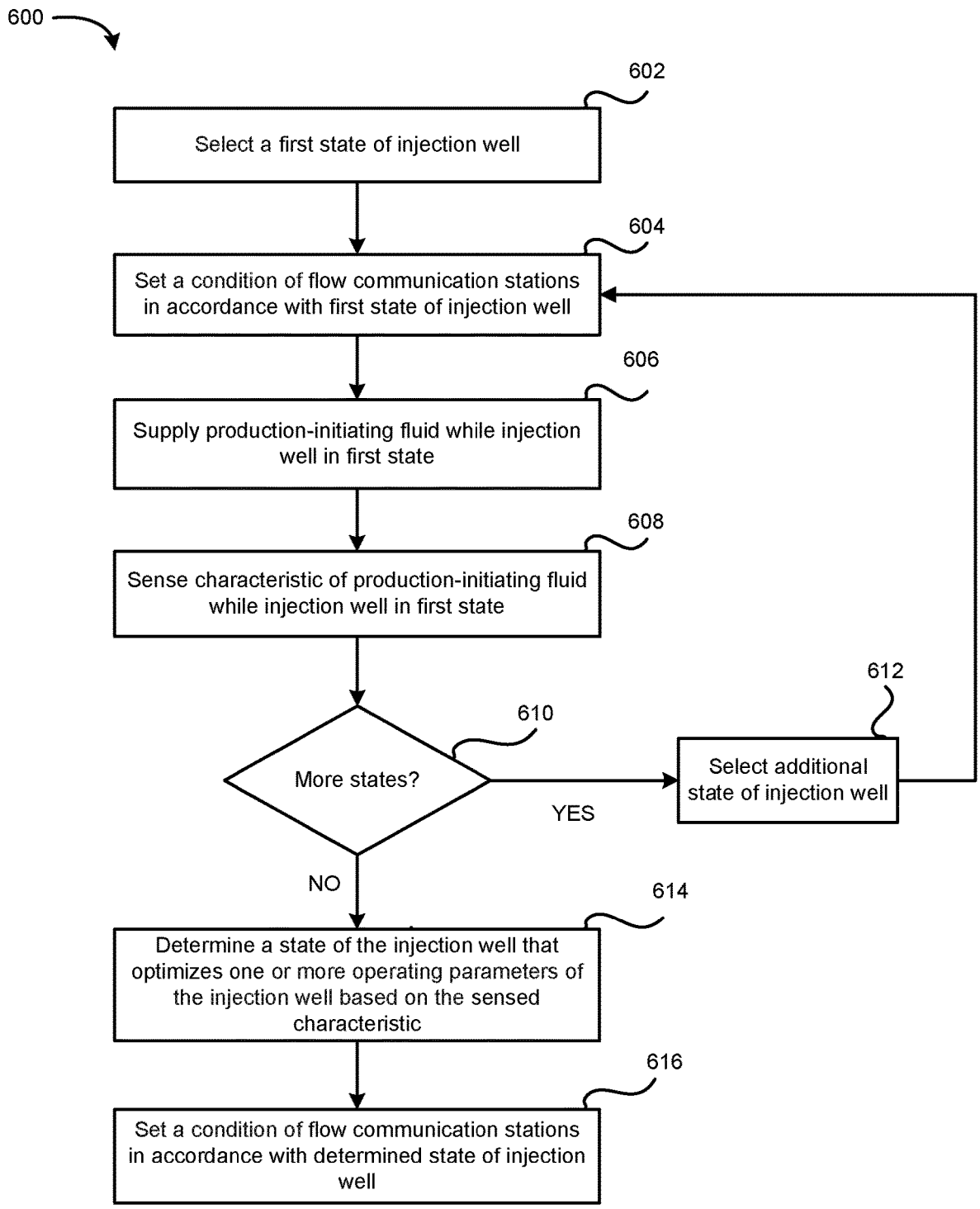
FIG. 9 is a flowchart of a method of controlling hydrocarbon production by a displacement process via a plurality of flow communication stations of an injection well in accordance with one example embodiment of the present disclosure.

Referring to FIG. 9, a method 600 of controlling hydrocarbon production of hydrocarbon material disposed within a subterranean formation 101 by a displacement process via a plurality of flow communication stations 110A-E of an injection well 104 in accordance with one example embodiment of the present disclosure will be described. In some embodiments, the displacement process is fluid injection. The injection well 104 has a plurality of states, each state being defined by a subset of the flow communication stations 110A-E disposed in an opened condition and a subset of the flow communication stations 110A-E disposed in a closed condition. At least parts of the method 600 are carried out by software executed by a processor, such as the processor 502 of the control system 500 at the surface 102.

The control system 500 may be a special purpose computer or general purpose computer running specialized control software.

At operation 602, the control system 500 selects a first state of the injection well 104 from a set of injection well states to be analyzed. The set of injection well states may comprise all working states of the injection well 104, i.e. the states of the injection well 104 in which at least one of the flow communication stations is disposed in the open condition, or a subset thereof. For n flow communication stations 110, there are $2^n-1$ working states (i.e., $2^n$ total states less the non-operating state in which all flow communication stations 110 are disposed in the closed position). The set of injection well states and the selection of the first state may be made automatically without user intervention or based on user input.

At operation 604, the control system 500 causes a condition of the flow communication stations 110A-E to be set in accordance with the first state of the injection well 104.

At operation 606, a production-initiating fluid, such as water, is supplied into the injection well 104 while the injection well 104 is in the first state. This may be caused by the control system 500 in some embodiments. The supplied production-initiating fluid is injected into the subterranean formation 101 via the flow communication stations 110A-E disposed in the opened condition while the injection well 104 is in the first state and displaces the hydrocarbon material from the subterranean formation 101 to a production well 106. In at least some embodiments, the production-initiating fluid is supplied at a substantially constant pressure. In some embodiments in which the production-initiating fluid is water, the pressure may be determined by the water source. For example, in some embodiments the production-initiating fluid is supplied at a pressure that varies less than 20%, preferably less than 10%, more preferably less than 5%.

At operation 608, a characteristic of the supplied production-initiating fluid that is disposed uphole of the flow communication stations 110A-E is sensed or measured while supplying the production-initiating fluid into the injection well 104 and the injection well 104 is in the first state. In some embodiments, the characteristic of the supplied production-initiating fluid that is sensed is a rate of flow. The rate of flow may be sensed or measured by a flow meter.

At operation 610, the control system 500 determines whether other states of the injection well 104 in the set of injection well states to be analyzed have yet to be processed. When no injection well states to be analyzed remain, processing proceeds to operation 614. However, when one or more injection well states to be analyzed remain, processing proceeds to operation 612, wherein the control system 500 selects an additional state of the injection well 104. The selection may be made automatically without user intervention or based on user input, for example, in accordance with a positional sequential (i.e., a sequence based on the position of the flow communication stations in the injection well 104) or otherwise. Next, operations 604, 606 and 608 are repeated for the selected state of the injection well 104. Operations 602-612 are repeated until all states of the injection well in the set of injection well states to be analyzed have been processed.

In some embodiments, the flow communication stations are sequentially set in a condition in accordance with each of the working states of the injection well, wherein in each working state of the injection well a particular subset of the flow communication stations are disposed in the opened condition and a particular subset of the flow communication stations are disposed in the closed condition, wherein the particular flow communication stations that are disposed in the opened condition and closed condition are unique to each working state of the injection well.

At operation 614, the control system 500 determines a state of the injection well 104 that optimizes one or more operating parameters of the injection well 104 based on the sensed characteristic of the supplied production-initiating fluid in the respective states of the injection well 104. In some embodiments, the one or more operating parameters comprise evenly distributing the flow among the flow communication stations, a total flow of production-initiating fluid to the flow communication stations, or both. It will be appreciated that the injection well 104 does not include any downhole sensors and that the sensed characteristic of the production-initiating fluid is determined exclusively at the surface 102 of the injection well 104, for example, at the wellhead of the injection well 104. Thus, the determination of the state of the injection well 104 that optimizes the one or more operating parameters of the injection well 104 is based exclusively on the sensed characteristic of the production-initiating fluid at the surface 102 of the injection well 104, for example, at the wellhead of the injection well 104.

At operation 616, the control system 500 causes a condition of the flow communication stations to be set in accordance with the determined state of the injection well 104. Production of hydrocarbon material can then proceed in accordance with more optimal operating parameters.

In at least some embodiments of the method 600, the flow communication stations 110 are sequentially set in a condition in accordance with each possible state of the injection well 104. In each possible state of the injection well 104, a particular subset of the flow communication stations 110A-E are disposed in the opened condition and a particular subset of the flow communication stations 110A-E are disposed in the closed condition. The particular flow communication stations 110A-E that are disposed in the opened condition and closed condition are unique to each possible state of the injection well 104. When the flow communication stations 110A-E are maintained in a condition in accordance with a respective state of the injection well 104, production-initiating fluid is supplied into the injection well 104, wherein the supplied production-initiating fluid is injected into the subterranean formation 101 via the flow communication stations 110A-E disposed in the opened condition while the flow communication stations 110A-E are maintained in a condition in accordance with the respective state of the injection well 104 and displaces the hydrocarbon material from the subterranean formation 101 to the production well 106. When the flow communication stations 110A-E are maintained in a condition in accordance with the respective state of the injection well 104 and production-initiating fluid is supplied into the injection well 104, the characteristic of the supplied production-initiating fluid that is disposed uphole of the flow communication stations 110A-E is sensed.

In some embodiments, the production-initiating fluid, whose characteristic is sensed, is a production-initiating fluid that is disposed above a surface of the injection well.

In some embodiments, the production-initiating fluid, whose characteristic is sensed, is a production-initiating fluid that is disposed at a wellhead of the injection well.

Figure 10:
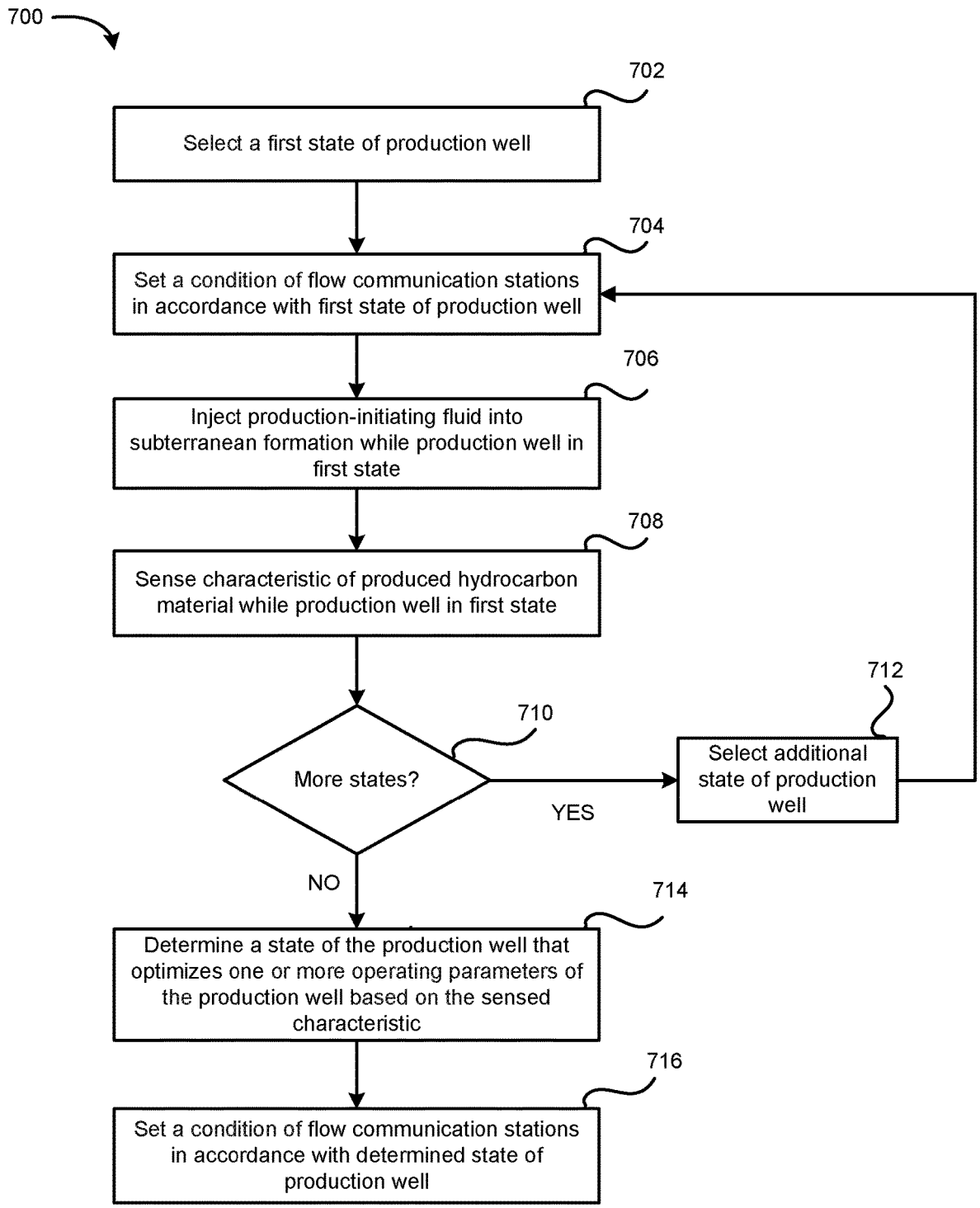
FIG. 10 is a flowchart of a method of controlling hydrocarbon production by a displacement process via a plurality of flow communication stations of a production well in accordance with another example embodiment of the present disclosure.

Referring to FIG. 10, a method 700 of controlling hydrocarbon production of hydrocarbon material disposed within a subterranean formation 101 by a displacement process via a plurality of flow communication stations 120A-E of a production well 106 in accordance with one example embodiment of the present disclosure will be described. In some embodiments, the displacement process is fluid injection. The production well 106 has a plurality of states, each state being defined by a subset of the flow communication stations 120A-E disposed in an opened condition and a subset of the flow communication stations 120A-E disposed in a closed condition. At least parts of the method 700 are carried out by software executed by a processor, such as the processor 502 of the control system 500 at the surface 102. The control system 500 may be a special purpose computer or general purpose computer running specialized control software.

At operation 702, the control system 500 selects a first state of the production well 106 from a set of production well states to be analyzed. The set of production well states may comprise all working states of the production well 106, i.e. the states of the production well 106 in which at least one of the flow communication stations is disposed in the open condition, or a subset thereof. For n flow communication stations 120, there are $2^n-1$ working states (i.e., $2^n$ total states less the non-operating state in which all flow communication stations 120 are disposed in the closed position). The set of production well states and the selection of the first state may be made automatically without user intervention or based on user input.

At operation 704, the control system 500 causes a condition of the flow communication stations 120A-E to be set in accordance with the first state of the production well 106.

At operation 706, a production-initiating fluid, such as water, is injected into the subterranean formation 101 while the production well 106 is in the first state. This may be caused by the control system 500 in some embodiments. In at least some embodiments, the production-initiating fluid is supplied at a substantially constant pressure. In some embodiments in which the production-initiating fluid is water, the pressure may be determined by the water source. For example, in some embodiments the production-initiating fluid is supplied at a pressure that varies less than 20%, preferably less than 10%, more preferably less than 5%.

At operation 708, a characteristic of the produced hydrocarbon material that is disposed uphole of the flow communication stations 120A-E is sensed or measured while the production well 106 is in the first state. In some embodiments, the characteristic of the produced hydrocarbon material that is sensed is a rate of flow. The rate of flow may be sensed or measured by a flow meter. In other embodiments, the characteristic of the produced hydrocarbon material that is sensed is a water cut of the produced hydrocarbon material. The water cut of the produced hydrocarbon material may be sensed or measured by a water cut meter. In yet other embodiments, both the flow rate and the cut rate may be sensed or measured.

At operation 710, the control system 500 determines whether other states of the production well 106 in the set of production well states to be analyzed have yet to be processed. When no production well states to be analyzed remain, processing proceeds to operation 714. However, when one or more production well states to be analyzed remain, processing proceeds to operation 712, wherein the control system 500 selects an additional state of the production well 106. The selection may be made automatically without user intervention or based on user input, for example, in accordance with a positional sequential (i.e., a sequence based on the position of the flow communication stations in the production well 106) or otherwise. Next, operations 704, 706 and 708 are repeated for the selected state of the production well 106. Operations 702-712 are repeated until all states of the production well 106 in the set of production well states to be analyzed have been processed.

In some embodiments, the flow communication stations are sequentially set in a condition in accordance with each of the working states of the production well, wherein in each working state of the production well a particular subset of the flow communication stations are disposed in the opened condition and a particular subset of the flow communication stations are disposed in the closed condition, wherein the particular flow communication stations that are disposed in the opened condition and closed condition are unique to each working state of the production well.

At operation 714, the control system 500 determines a state of the production well 106 that optimizes one or more operating parameters of the production well 106 based on the sensed characteristic of the produced hydrocarbon material in the respective states of the production well 106. In some embodiments, the one or more operating parameters comprise evenly distributing the flow among the flow communication stations, a total flow of produced hydrocarbon material, or both. It will be appreciated that the production well 106 does not include any downhole sensors and that the sensed characteristic of the produced hydrocarbon material is determined exclusively at the surface 102 of the production well 106, for example, at the wellhead of the production well 106. Thus, the determination of the state of the production well 106 that optimizes the one or more operating parameters of the production well 106 is based exclusively on the sensed characteristic of the the produced hydrocarbon material at the surface 102 of the production well 106, for example, at the wellhead of the production well 106.

At operation 716, the control system 500 sets a condition of the flow communication stations 120A-E in accordance with the determined state of the production well 106. Production of hydrocarbon material can then proceed in accordance with more optimal operating parameters.

In some embodiments, the produced hydrocarbon material, whose characteristic is sensed, is a produced hydrocarbon material that is disposed above a surface of the production well.

In some embodiments, the produced hydrocarbon material, whose characteristic is sensed, is a produced hydrocarbon material that is disposed at a wellhead of the production well.

In at least some embodiments of the method 700, the flow communication stations 120A-E are sequentially set in a condition in accordance with each possible state of the production well 106. In each possible state of the production well 106 a particular subset of the flow communication stations 120A-E are disposed in the opened condition and a particular subset of the flow communication stations 120A-E are disposed in the closed condition. The particular flow communication stations 120A-E that are disposed in the opened condition and closed condition are unique to each possible state of the production well 106. When the flow communication stations 120A-E are maintained in a condition in accordance with a respective state of the production well 106, the hydrocarbon material is displaced from the subterranean formation 101 to the production well 106 via the flow communication stations 120A-E disposed in the opened condition while the flow communication stations 120A-E are maintained in a condition in accordance with the respective state of the production well 106. When the flow communication stations 120A-E are maintained in a condition in accordance with the respective state of the production well 106 and production-initiating fluid is injected into the subterranean formation 101, the characteristic of the produced hydrocarbon material that is disposed uphole of the flow communication stations 120A-E is sensed.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of the present disclosure. All such modifications and variations, including all suitable current and future changes in technology, are believed to be within the sphere and scope of the present disclosure.

The invention claimed is:

1. A method of controlling hydrocarbon production of hydrocarbon material disposed within a subterranean formation by a displacement process via a plurality of flow communication stations of an injection well, the injection well having a plurality of states, each state being defined by a subset of the flow communication stations disposed in an opened condition and a subset of the flow communication stations disposed in a closed condition, the method comprising:

for at least some of the states of the injection well, (i) setting a condition of the flow communication stations in accordance with a respective state of the injection well, (ii) supplying a production-initiating fluid into the injection well while the injection well is in the respective state, wherein the supplied production-initiating fluid is injected into the subterranean formation via the flow communication stations disposed in the opened condition while the injection well is in the respective state and displaces the hydrocarbon material from the subterranean formation to a production well, and (iii) sensing a characteristic of the supplied production-initiating fluid that is disposed uphole of the flow communication stations while supplying the production-initiating fluid into the injection well and the injection well is in the respective state;

determining a state of the injection well that optimizes one or more operating parameters of the injection well based on the sensed characteristic of the supplied production-initiating fluid in each of the respective states of the injection well, wherein the one or more operating parameters comprise a total flow of production-initiating fluid to the flow communication stations; and setting a condition of the flow communication stations in accordance with the determined state of the injection well.

2. The method of claim 1, wherein each of the flow communication stations is operable between binary opened and closed conditions defining 2^n−1 working states where n corresponds to a total number of the flow communication stations, further wherein steps (i) to (iii) are performed for a plurality of the 2^n−1 working states of the injection well.

3. The method of claim 1, wherein each state of the injection well is defined by a unique combination of flow communication stations disposed in the opened condition and in the closed condition.

4. The method of claim 1, wherein the one or more operating parameters comprise evenly distributing the flow among the flow communication stations disposed in the open condition.

5. The method of claim 1, wherein the characteristic of the supplied production-initiating fluid that is sensed is a rate of flow.

6. The method of claim 5, wherein the rate of flow is sensed by a flow meter.

7. The method of claim 1, wherein the production-initiating fluid, whose characteristic is sensed, is a production-initiating fluid that is disposed above a surface of the injection well, wherein the step of determining the state of the injection well that optimizes the one or more operating parameters of the injection well is based exclusively on the sensed characteristic of the production-initiating fluid at the surface of the injection well.

8. The method of claim 1, wherein the production-initiating fluid, whose characteristic is sensed, is a production-initiating fluid that is disposed at a wellhead of the injection well, wherein the step of determining the state of the injection well that optimizes the one or more operating parameters of the injection well is based exclusively on the sensed characteristic of the production-initiating fluid at the wellhead of the injection well.

9. A control system for controlling hydrocarbon production of hydrocarbon material disposed within a subterranean formation by a displacement process via a plurality of flow communication stations of an injection well, the injection well having a plurality of states, each state being defined by a subset of the flow communication stations disposed in an opened condition and a subset of the flow communication stations disposed in a closed condition, the control system comprising:

a processor;

a memory coupled to the processor, the memory storing executable instructions that, when executed by the processor, cause the control system to:

for at least some of the states of the injection well, (i) seta condition of the flow communication stations in accordance with a respective state of the injection well, (ii) supply a production-initiating fluid into the injection well while the injection well is in the respective state, wherein the supplied production-initiating fluid is injected into the subterranean formation via the flow communication stations disposed in the opened condition while the injection well is in the respective state and displaces the hydrocarbon material from the subterranean formation to a production well, and (iii) sense a characteristic of the supplied production-initiating fluid that is disposed uphole of the flow communication stations while supplying the production-initiating fluid into the injection well and the injection well is in the respective state;

determine a state of the injection well that optimizes one or more operating parameters of the injection well based on the sensed characteristic of the supplied production-initiating fluid in each of the respective states of the injection well, wherein the one or more operating parameters comprise a total flow of production-initiating fluid to the flow communication stations; and set a condition of the flow communication stations in accordance with the determined state of the injection well.

10. The system of claim 9, wherein each of the flow communication stations is operable between binary opened and closed conditions defining 2^n−1 working states where n corresponds to a total number of the flow communication stations, further wherein the executable instructions, when executed by the processor, cause the control system to perform steps (i) to (iii) for a plurality of the 2^n−1 working states of the injection well.

11. The system of claim 9, wherein each working state of the injection well is defined by a unique combination of flow communication stations disposed in the opened condition and in the closed condition.

12. The system of claim 9, wherein the one or more operating parameters comprise evenly distributing the flow among the flow communication stations disposed in the open condition.

13. The system of claim 9, wherein the characteristic of the supplied production-initiating fluid that is sensed is a rate of flow.

14. The system of claim 13, wherein the rate of flow is sensed by a flow meter.

15. The system of claim 9, wherein the production-initiating fluid, whose characteristic is sensed, is a production-initiating fluid that is disposed above a surface of the injection well, wherein the state of the injection well that optimizes the one or more operating parameters of the injection well is determined based exclusively on the sensed characteristic of the production-initiating fluid at the surface of the injection well.

16. The method of claim 9, wherein the production-initiating fluid, whose characteristic is sensed, is a production-initiating fluid that is disposed at a wellhead of the injection well, wherein the state of the injection well that optimizes the one or more operating parameters of the injection well is determined based exclusively on the sensed characteristic of the production-initiating fluid at the wellhead of the injection well.

17. A non-transitory computer-readable medium having instructions stored thereon which, when executed by a processor, cause the processor to:

for at least some of a plurality of states of an injection well, each state being defined by a subset of a plurality of flow communication stations in the injection well being disposed in an opened condition and a subset of the plurality of flow communication stations being disposed in a closed condition:

(i) set a condition of the flow communication stations in accordance with a respective state of the injection well, (ii) supply a production-initiating fluid into the injection well while the injection well is in the respective state, wherein the supplied production-initiating fluid is injected into a subterranean formation via the flow communication stations disposed in the opened condition while the injection well is in the respective state and displaces hydrocarbon material from the subterranean formation to a production well, and (iii) sense a characteristic of the supplied production-initiating fluid that is disposed uphole of the flow communication stations while supplying the production-initiating fluid into the injection well and the injection well is in the respective state;

determine a state of the injection well that optimizes one or more operating parameters of the injection well based on the sensed characteristic of the supplied production-initiating fluid in each of the respective states of the injection well, wherein the one or more operating parameters comprise a total flow of production-initiating fluid to the flow communication stations; and set a condition of the flow communication stations in accordance with the determined state of the injection well.

18. The non-transitory computer-readable medium of claim 17, wherein each of the flow communication stations is operable between binary opened and closed conditions defining 2^n−1 working states where n corresponds to a total number of the flow communication stations, further wherein steps (i) to (iii) are performed for a plurality of the 2^n−1 working states of the injection well.

19. The non-transitory computer-readable medium of claim 17, wherein each state of the injection well is defined by a unique combination of flow communication stations disposed in the opened condition and in the closed condition.

20. The non-transitory computer-readable medium of claim 17, wherein the one or more operating parameters comprise evenly distributing the flow among the flow communication stations disposed in the open condition.

* * * * *